US009039957B2

(12) United States Patent
Shiraishi et al.

(10) Patent No.: US 9,039,957 B2
(45) Date of Patent: May 26, 2015

(54) TARGET MATERIAL REFINEMENT DEVICE AND TARGET SUPPLY APPARATUS

(71) Applicant: Gigaphoton Inc., Oyama-shi, Tochigi (JP)

(72) Inventors: Yutaka Shiraishi, Oyama (JP); Osamu Wakabayashi, Oyama (JP)

(73) Assignee: GIGAPHOTON INC., Tochigi (JP)

( * ) Notice: Subject to any disclaimer, the term of this patent is extended or adjusted under 35 U.S.C. 154(b) by 115 days.

(21) Appl. No.: 13/770,939

(22) Filed: Feb. 19, 2013

(65) Prior Publication Data

US 2013/0221587 A1 Aug. 29, 2013

(30) Foreign Application Priority Data

Feb. 23, 2012 (JP) ..... 2012-037771
Nov. 14, 2012 (JP) ..... 2012-250018

(51) Int. Cl.
*C22B 9/00* (2006.01)
*H05G 2/00* (2006.01)

(52) U.S. Cl.
CPC *C22B 9/00* (2013.01); *H05G 2/005* (2013.01); *H05G 2/006* (2013.01); *H05G 2/008* (2013.01)

(58) Field of Classification Search
CPC ..... C22B 9/00
USPC ..... 266/171, 200, 208, 211
See application file for complete search history.

(56) References Cited

U.S. PATENT DOCUMENTS 7,122,816 B2 10/2006 Algots et al.
7,357,902 B2 * 4/2008 Hague et al. ..... 423/219
7,449,703 B2 11/2008 Bykanov
2010/0143202 A1 6/2010 Yabu et al.

FOREIGN PATENT DOCUMENTS

JP 2005-032510 A 2/2005

OTHER PUBLICATIONS

T.A. Ramanarayanan et al., "The Diffusivity and Solubility of Oxygen in Liquid Tin and Solid Silver and the Diffusivity", Metallurgical and Materials Transactions, Dec. 1972, pp. 3239-3246, vol. 3, Issue 1, Springer-Verlag, U.S.A.
Shinya Otsuka et al., "Oxygen Solubility in Liquid Indium and Oxygen Diffusivity in Liquid Indium and Tin", Metallurgical and Materials Transactions B, Jun. 1984, pp. 329-335, vol. 15, Issue 2, Springer-Verlag, U.S.A.

* cited by examiner

*Primary Examiner* — Scott Kastler
(74) *Attorney, Agent, or Firm* — McDermott Will & Emery LLP

(57) ABSTRACT

A target material refinement device may include a refinement tank to accommodate a target material, a heating section to heat the interior of the refinement tank, and an oxygen-atom removing section to remove oxygen atoms present in the target material.

9 Claims, 23 Drawing Sheets

TARGET MATERIAL REFINEMENT DEVICE AND TARGET SUPPLY APPARATUS

CROSS-REFERENCE TO RELATED APPLICATIONS

The present application claims priority from Japanese Patent Application No. 2012-037771 filed Feb. 23, 2012, and Japanese Patent Application No. 2012-250018 filed Nov. 14, 2012.

BACKGROUND

1. Technical Field

This disclosure relates to target material refinement devices and target supply apparatuses.

2. Related Art

In recent years, semiconductor production processes have become capable of producing semiconductor devices with increasingly fine feature sizes, as photolithography has been making rapid progress toward finer fabrication. In the next generation of semiconductor production processes, microfabrication with feature sizes at 60 nm to 45 nm, and further, microfabrication with feature sizes of 32 nm or less will be required. In order to meet the demand for microfabrication with feature sizes of 32 nm or less, for example, an exposure apparatus is needed in which a system for generating EUV light at a wavelength of approximately 13 nm is combined with a reduced projection reflective optical system.

Three kinds of systems for generating EUV light are known in general, which include a Laser Produced Plasma (LPP) type system in which plasma is generated by irradiating a target material with a laser beam, a Discharge Produced Plasma (DPP) type system in which plasma is generated by electric discharge, and a Synchrotron Radiation (SR) type system in which orbital radiation is used to generate plasma.

SUMMARY

A target material refinement device according to one aspect of this disclosure may include a refinement tank, a heating section, and an oxygen-atom removing section. The refinement tank may be configured to accommodate a target material. The heating section may be configured to heat the interior of the refinement tank. The oxygen-atom removing section may be configured to remove oxygen atoms present in the target material.

A target supply apparatus according to another aspect of this disclosure may include the target material refinement device, and a nozzle which has a through-hole and is disposed so that the through-hole communicates with the interior of the refinement tank of the target material refinement device.

A target supply apparatus according to still another aspect of the present disclosure may include the target material refinement device, a target generator, a generator heating section, a transfer section, and a target supply controller. The target generator may be configured to output a target material into a chamber where EUV light is generated. The generator heating section may be configured to heat and melt the target material in the target generator. The transfer section may be configured to transfer the target material in the refinement tank of the target material refinement device to the target generator. The target supply controller may be configured to control the temperature of the target material in the target generator to be higher than that of the target material in the refinement tank.

BRIEF DESCRIPTION OF THE DRAWINGS

Exemplary embodiments of the present disclosure will be described hereinafter with reference to the appended drawings.

DETAILED DESCRIPTION

Contents

Figure 1:
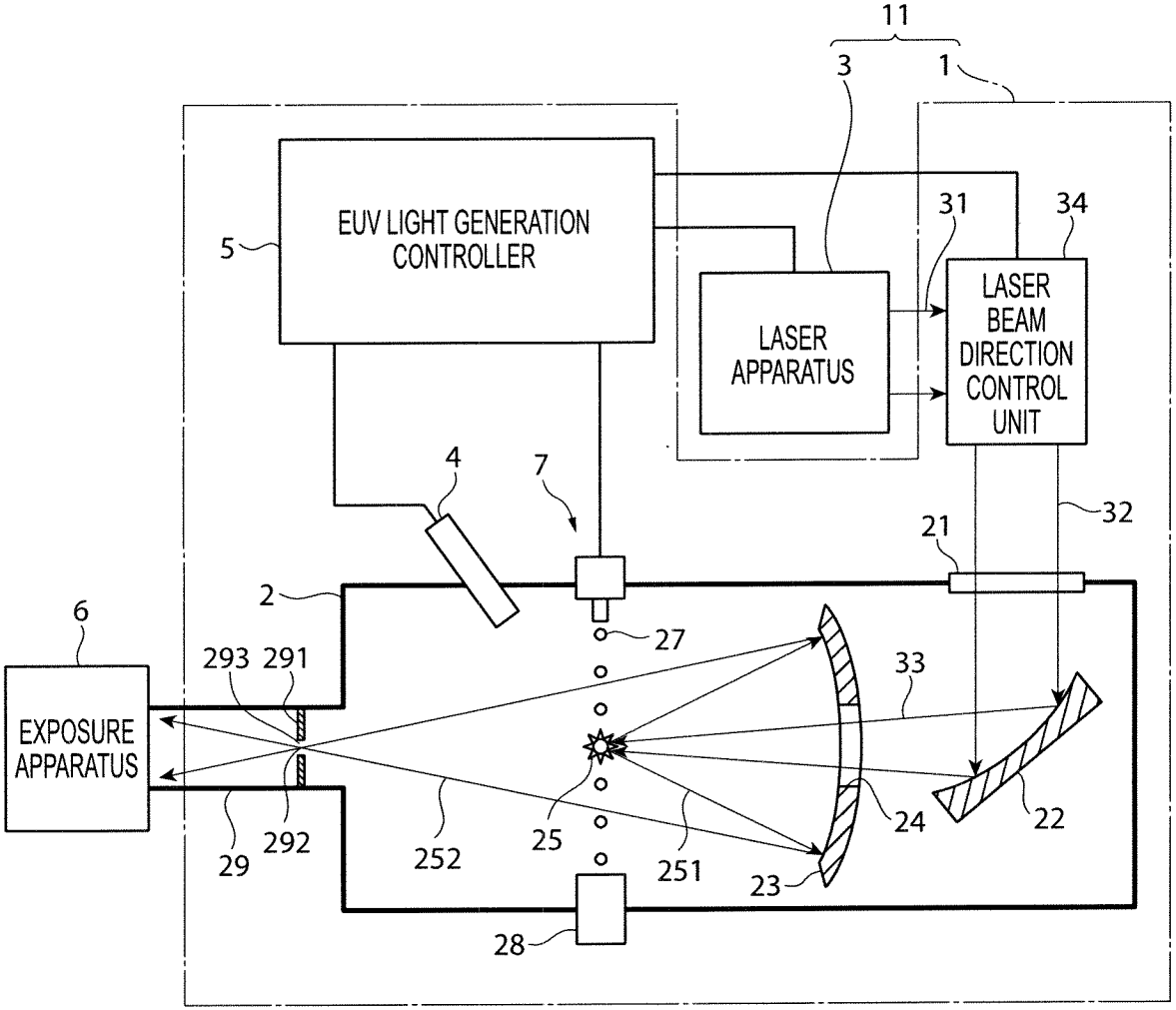
FIG. 1 is a schematic view illustrating the configuration of an exemplary LPP-type EUV light generation apparatus.

1. Overview
2. Overall Description of EUV Light Generation Apparatus
2.1 Configuration
2.2 Operation
3. EUV Light Generation Apparatus Including Piezoelectric Element
3.1 Configuration
3.2 Operation
4. EUV Light Generation Apparatus Including Piezoelectric Element and Temperature Control Section
4.1 Configuration
4.2 Operation
5. Target material Refinement Device
5.1 Terms
5.2 First Embodiment
5.2.1 Outline
5.2.2 Solubility of Oxygen Atoms in Tin
5.2.3 Configuration
5.2.4 Operation
5.3 Second Embodiment
5.3.1 Outline
5.3.2 Configuration
5.3.3 Operation
5.4 Third Embodiment
5.4.1 Outline
5.4.2 Configuration
5.4.3 Operation
5.5 Fourth Embodiment
5.5.1 Outline
5.5.2 Configuration
5.5.3 Operation
5.6 Fifth Embodiment
5.6.1 Outline
5.6.2 Configuration
5.6.3 Operation
5.7 Sixth Embodiment
5.7.1 Outline
5.7.2 Configuration
5.7.3 Operation
6. EUV Light Generation Apparatus Including Target material Refinement Device
6.1 Seventh Embodiment
6.1.1 Outline
6.1.2 Configuration
6.1.3 Operation
6.2 Eighth Embodiment
6.2.1 Outline
6.2.2 Configuration
6.2.3 Operation Embodiments of the present disclosure will be described in detail hereinafter with reference to the drawings. The embodiments described hereinafter indicate several examples of the present disclosure, and are not intended to limit the content of the present disclosure. Furthermore, not all of the configurations and operations described in the embodiments are required configurations and operations in the present disclosure. Note that identical constituent elements will be given identical reference numerals, and redundant descriptions thereof will be omitted.

1. Overview

In an embodiment of this disclosure, a target material refinement device may include a refinement tank, a heating section, and an oxygen-atom removing section. The refinement tank may accommodate a target material in a sealed space. The heating section may heat and melt the target material in the sealed space. The oxygen-atom removing section may remove oxygen atoms present in the target material.

Here, oxygen atoms may be dissolved within the target material. The solubility of the oxygen atoms within the target material may be lower as the temperature of the target material drops. For this reason, a phenomenon such as that described hereinafter may occur. That is, with a target material that has been melted by being heated to a predetermined temperature (sometimes called a "first melting temperature" hereinafter), an amount (sometimes called a "first dissolving amount" hereinafter) of oxygen atoms that corresponds to the first melting temperature may be dissolved into the target material. When the temperature of the target material drops, the target material may harden while still containing the first dissolving amount of oxygen atoms. When the target material is then melted at a second melting temperature, which is lower than the first melting temperature, for use in the generation of EUV light, an amount (sometimes called a "second dissolving amount" hereinafter) of oxygen atoms that corresponds to the second melting temperature may be dissolved into the melted target material. As described above, the solubility of oxygen atoms drops as the temperature of the target material decreases, and thus the second dissolving amount may be lower than the first dissolving amount. Accordingly, an amount of oxygen atoms obtained by subtracting the second dissolving amount from the first dissolving amount may be incapable of being dissolved into the target material that has been melted at the second melting temperature. As a result, the oxygen atoms that cannot be dissolved may attach to the target material, resulting in the separation of oxidants from the target material. The separated oxidants may clog a nozzle hole in the nozzle. The output direction of the target material may change if the separated oxidants accumulate in the nozzle hole.

The target material refinement device according to the embodiment of this disclosure may decrease oxygen atoms present in the target material. Therefore, in the case where this target material is used for the generation of EUV light, it is possible to suppress the separation of oxidants of the target material, and the likelihood that the nozzle hole will be clogged by oxidants may be reduced. Further still, the likelihood that oxidants will accumulate in the nozzle hole may be reduced, and as a result, changes in the output direction of the target material may be suppressed.

2. Overview of EUV Light Generation System

2.1 Configuration

FIG. 1 schematically illustrates an exemplary configuration of an LPP type EUV light generation system. An EUV light generation apparatus 1 may be used with at least one laser apparatus 3. Hereinafter, a system that includes the EUV light generation apparatus 1 and the laser apparatus 3 may be referred to as an EUV light generation system 11. As shown in FIG. 1 and described in detail below, the EUV light generation system 11 may include a chamber 2 and a target supply device 7. The chamber 2 may be sealed airtight. The target supply device 7 may be mounted onto the chamber 2, for example, to penetrate a wall of the chamber 2. A target material to be supplied by the target supply device 7 may include, but is not limited to, tin, terbium, gadolinium, lithium, xenon, or any combination thereof.

The chamber 2 may have at least one through-hole or opening formed in its wall, and a pulse laser beam 32 may travel through the through-hole/opening into the chamber 2. Alternatively, the chamber 2 may have a window 21, through which the pulse laser beam 32 may travel into the chamber 2. An EUV collector mirror 23 having a spheroidal surface may, for example, be provided in the chamber 2. The EUV collector mirror 23 may have a multi-layered reflective film formed on the spheroidal surface thereof. The reflective film may include a molybdenum layer and a silicon layer, which are alternately laminated. The EUV collector mirror 23 may have a first focus and a second focus, and may be positioned such that the first focus lies in a plasma generation region 25 and the second focus lies in an intermediate focus (IF) region 292 defined by the specifications of an external apparatus, such as an exposure apparatus 6. The EUV collector mirror 23 may have a through-hole 24 formed at the center thereof so that a pulse laser beam 33 may travel through the through-hole 24 toward the plasma generation region 25.

The EUV light generation system 11 may further include an EUV light generation controller 5 and a target sensor 4. The target sensor 4 may have an imaging function and detect at least one of the presence, trajectory, position, and speed of a target 27.

Further, the EUV light generation system 11 may include a connection part 29 for allowing the interior of the chamber 2 to be in communication with the interior of the exposure apparatus 6. A wall 291 having an aperture 293 may be provided in the connection part 29. The wall 291 may be positioned such that the second focus of the EUV collector mirror 23 lies in the aperture 293 formed in the wall 291.

The EUV light generation system 11 may also include a laser beam direction control unit 34, a laser beam focusing mirror 22, and a target collector 28 for collecting targets 27. The laser beam direction control unit 34 may include an optical element (not separately shown) for defining the direction into which the pulse laser beam 32 travels and an actuator (not separately shown) for adjusting the position and the orientation or posture of the optical element.

2.2 Operation

With continued reference to FIG. 1, a pulse laser beam 31 outputted from the laser apparatus 3 may pass through the laser beam direction control unit 34 and be outputted therefrom as the pulse laser beam 32 after having its direction optionally adjusted. The pulse laser beam 32 may travel through the window 21 and enter the chamber 2. The pulse laser beam 32 may travel inside the chamber 2 along at least one beam path from the laser apparatus 3, be reflected by the laser beam focusing mirror 22, and strike at least one target 27 as a pulse laser beam 33.

The target supply device 7 may be configured to output the target(s) 27 toward the plasma generation region 25 in the chamber 2. The target 27 may be irradiated with at least one pulse of the pulse laser beam 33. Upon being irradiated with the pulse laser beam 33, the target 27 may be turned into plasma, and rays of light 251 including EUV light may be emitted from the plasma. At least the EUV light included in the light 251 may be reflected selectively by the EUV collector mirror 23. EUV light 252, which is the light reflected by the EUV collector mirror 23, may travel through the intermediate focus region 292 and be outputted to the exposure apparatus 6. Here, the target 27 may be irradiated with multiple pulses included in the pulse laser beam 33.

The EUV light generation controller 5 may be configured to integrally control the EUV light generation system 11. The EUV light generation controller 5 may be configured to process image data of the target 27 captured by the target sensor 4. Further, the EUV light generation controller 5 may be configured to control at least one of: the timing when the target 27 is outputted and the direction into which the target 27 is outputted. Furthermore, the EUV light generation controller 5 may be configured to control at least one of: the timing when the laser apparatus 3 oscillates, the direction in which the pulse laser beam 33 travels, and the position at which the pulse laser beam 33 is focused. It will be appreciated that the various controls mentioned above are merely examples, and other controls may be added as necessary.

3. EUV Light Generation Apparatus Including Piezoelectric Element

3.1 Configuration

Figure 2:
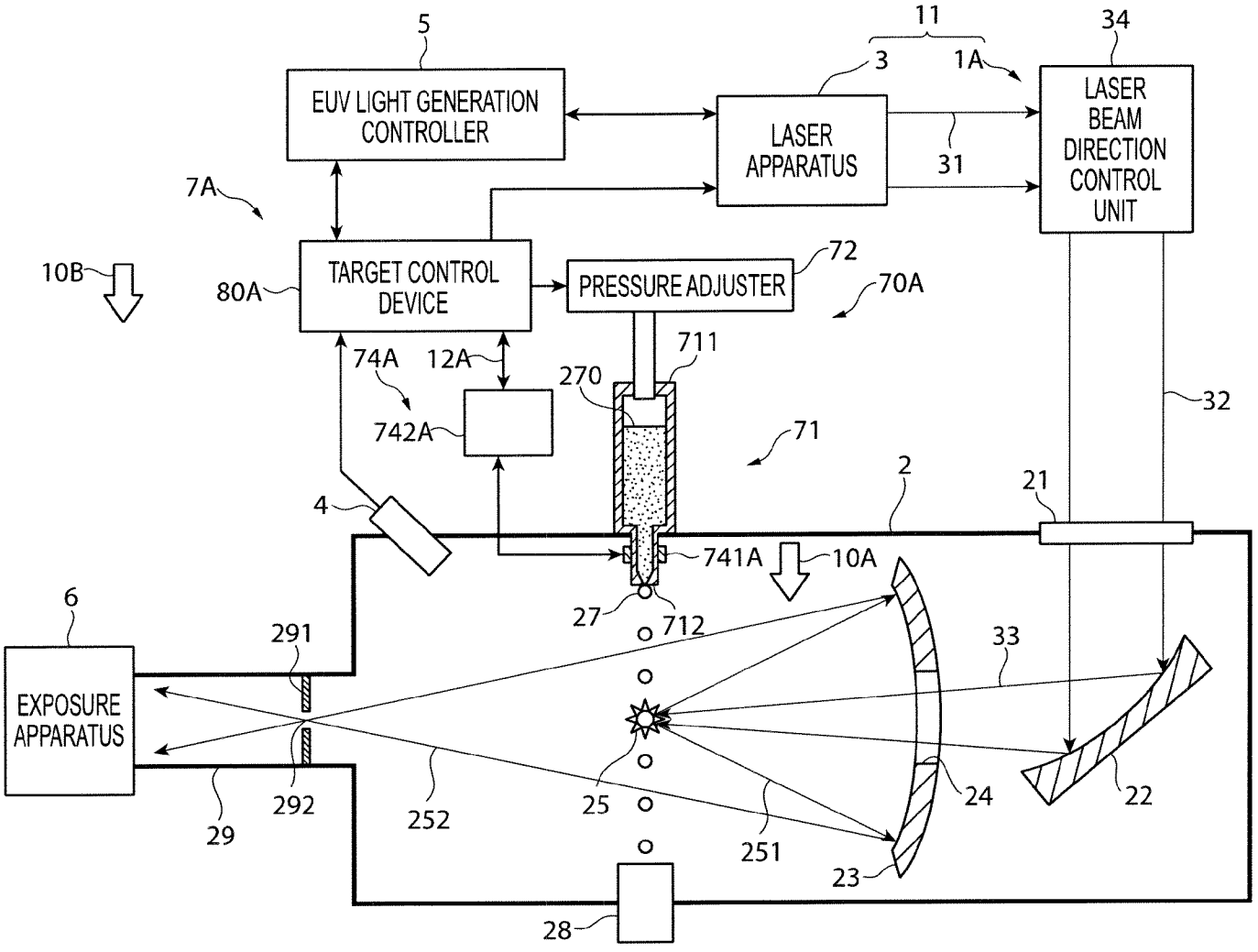
FIG. 2 is a schematic view illustrating the configuration of an EUV light generation apparatus including a piezoelectric element.

FIG. 2 schematically illustrates the configuration of an EUV light generation apparatus including a piezoelectric element.

An EUV light generation apparatus 1A may, as shown in FIG. 2, include the chamber 2 and a target supply apparatus 7A. The target supply apparatus 7A may include a target generation section 70A and a target control device 80A.

The target generation section 70A may include a target generator 71, a pressure adjuster 72, and a piezoelectric driver 74A. The target generator 71 may, in its interior, include a tank 711 for holding a target material 270. The tank 711 may be cylindrical in shape. A nozzle 712 for outputting the target material 270 in the tank 711 to the chamber 2 as the droplets 27 may be provided in the tank 711. A nozzle hole may be provided in a leading end area of the nozzle 712. The target generator 71 may be provided so that the tank 711 is positioned outside of the chamber 2 and the nozzle 712 is positioned inside of the chamber 2. The pressure adjuster 72 may be connected to the tank 711. In addition, the pressure adjuster 72 may be electrically connected to the target control device 80A.

The piezoelectric driver 74A may include a piezoelectric element 741A and a piezoelectric element power source 742A. The piezoelectric element 741A may be provided within the chamber 2 and on the outer circumferential surface of the nozzle 712, for example. Instead of the piezoelectric element 741A, a mechanism capable of applying a mechanical force on the nozzle 712 at high speeds may be provided. The piezoelectric element power source 742A may be connected to the piezoelectric element 741A via a feedthrough (not shown) provided in a wall area of the chamber 2. The piezoelectric element power source 742A may be connected to the target control device 80A.

Depending on how the chamber 2 is arranged, it is not necessarily the case that a pre-set output direction for the target material 270 (axial direction of the nozzle 712 (referred to as a "set output direction 10A")) will match a gravitational direction 10B. The pre-set output direction of the target material 270 may be the same as the axial direction of the nozzle 712, and will hereinafter sometimes be referred to as the set output direction 10A. The configuration may be such that the target material 270 is outputted at an angle or horizontally relative to the gravitational direction 10B. Note that the first embodiment and the following second through fifth embodiments describe cases in which the chamber 2 is arranged so that the set output direction 10A and the gravitational direction 10B match.

3.2 Operation

At the time of generation of the EUV light, the target control device 80A may adjust the pressure within the tank 711 to a predetermined pressure by sending a signal to the pressure adjuster 72. This predetermined pressure may be a pressure of a magnitude that forms a meniscus surface of the target material 270 at the nozzle hole, and the droplet 27 may not be outputted in this state.

After this, the target control device 80A may, for example, send a droplet generation signal 12A to the piezoelectric element power source 742A in order to generate the droplets 27 on demand. Having received the droplet generation signal 12A, the piezoelectric element power source 742A may supply predetermined pulsed electrical power to the piezoelectric element 741A.

Having been supplied with the electrical power, the piezoelectric element 741A may deform in accordance with the timing of the electrical power supply. As a result, the periphery of the nozzle 712 may be compressed at a high speed, and the droplets 27 may be outputted as a result. If the predetermined pressure is maintained within the tank 711, the droplets 27 may be outputted in accordance with the timing of the electrical power supply.

Alternatively, the target control device 80A may be configured so as to adjust the pressure in the tank 711 so that a jet is generated as a continuous jet. The pressure within the tank 711 at this time may be a higher pressure than the predetermined pressure mentioned above, and the target material may be outputted in a jet-like manner via the nozzle 712. The target control device 80A may send a vibration signal to the piezoelectric element power source 742A in order to generate the droplets. Having received the vibration signal, the piezoelectric element power source 742A may supply electrical power for causing the piezoelectric element 741A to vibrate to the piezoelectric element 741A.

Having been supplied with electrical power, the piezoelectric element 741A may cause the nozzle 712 to vibrate at a high speed. Through this, the jet is interrupted at a constant cycle, and is thus outputted as the droplets. EUV light may be generated by irradiating the droplets outputted in this manner with a pulsed laser beam.

4. EUV Light Generation Apparatus Including Piezoelectric Element and Temperature Control Section

4.1 Configuration

Figure 3:
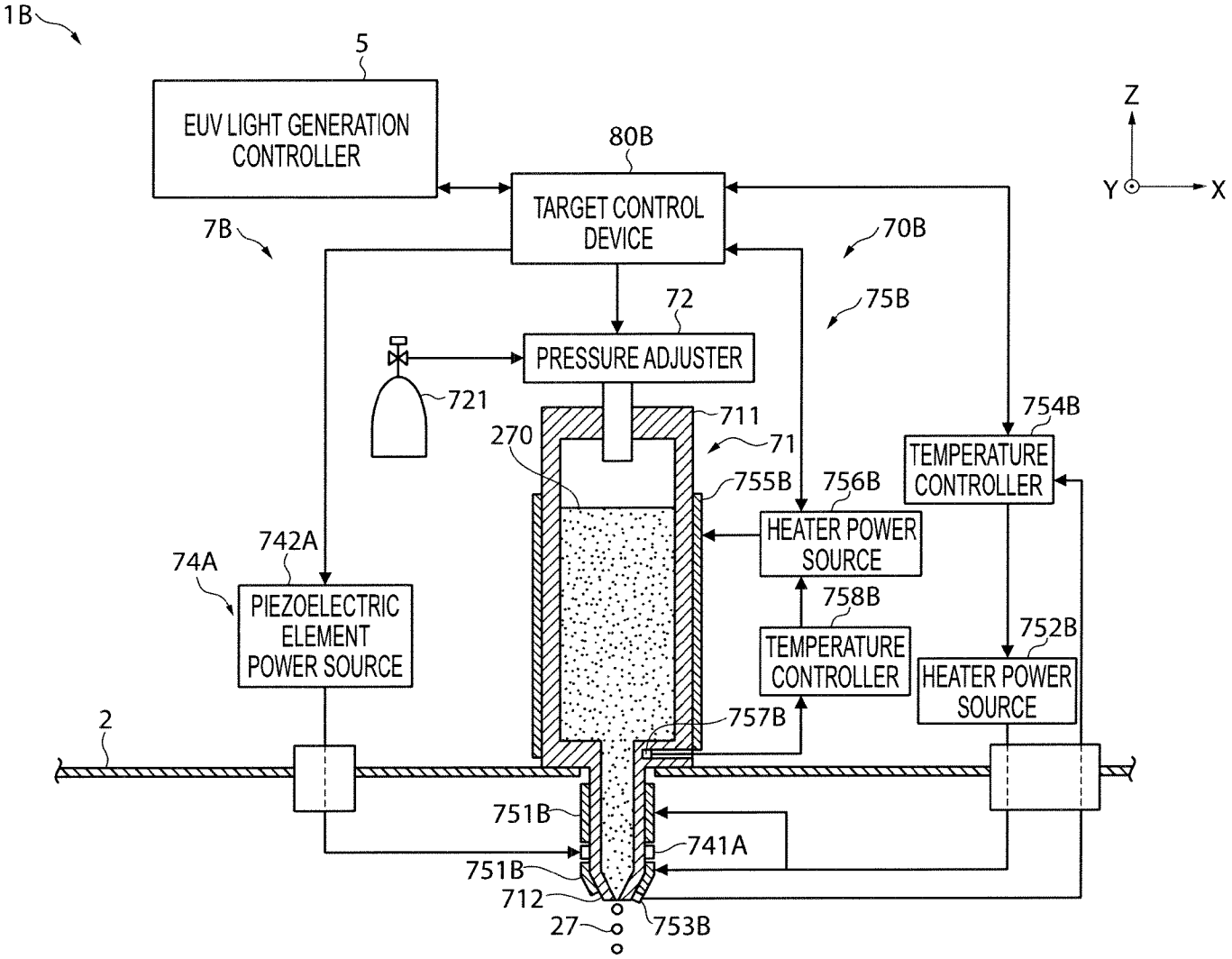
FIG. 3 is a schematic view illustrating the configuration of an EUV light generation apparatus including a piezoelectric element and a temperature control section.

FIG. 3 schematically illustrates the configuration of an EUV light generation apparatus including a piezoelectric element and a temperature control section.

As shown in FIG. 3, a target supply apparatus 7B included in an EUV light generation apparatus 1B may have a target generation section 70B and a target control device 80B.

The target generation section 70B may include the target generator 71, the pressure adjuster 72, the piezoelectric driver 74A, and a temperature adjustment section 75B.

An inert gas tank 721 may be connected to the pressure adjuster 72. The pressure adjuster 72 may be configured so as to adjust the pressure within the tank 711 by controlling the pressure of an inert gas supplied from the inert gas tank 721.

The temperature adjustment section 753 may be so configured as to adjust the temperature of the target material 270 in the tank 711. The temperature adjustment section 75B may include first heaters 751B, a first heater power source 752B, a first temperature sensor 753B, a first temperature controller 754B, a second heater 755B, a second heater power source 756B, a second temperature sensor 757B, and a second temperature controller 758B. The first heaters 751B and the second heater 755B may be disposed in a circular manner on the circumferences of the nozzle 712 and the tank 711.

The first heaters 75B may be provided on the upper end side and the lower end side of the outer circumferential surface of the nozzle 712. The first heater power source 752B may be electrically connected to the first heaters 751B and the first temperature controller 754B. The first heater power source 752B may cause the first heaters 751B to emit heat by supplying electric power to the first heaters 751B based on a signal from the first temperature controller 754B. As a result, the target material 270 within the nozzle 712 may be heated.

The first temperature sensor 753B may be provided on the outer circumferential surface of the nozzle 712. The first temperature controller 754B may be electrically connected to the first temperature sensor 753B. The first temperature sensor 753B may be so configured as to detect the temperature of the nozzle 712 and send a signal corresponding to the detected temperature to the first temperature controller 754B. The first temperature controller 754B may be so configured as to determine, based on the signal from the first temperature sensor 753B, the temperature of the target material 270 within the nozzle 712 and output a signal to the first heater power source 7523 for adjusting the temperature of the target material 270 within the nozzle 712 to a predetermined temperature.

The second heater 755B may be provided on the outer circumferential surface of the tank 711. The second heater power source 756B may be electrically connected to the second heater 7553 and the second temperature controller 758B, and may supply electric power to the second heater 755B based on a signal from the second temperature controller 758B.

The second temperature sensor 757B may be provided on the outer circumferential surface of the tank 711 and electrically connected to the second temperature controller 758B. The second temperature sensor 757B may be so configured as to detect the temperature of the tank 711 and send a signal corresponding to the detected temperature to the second temperature controller 758B. The second temperature controller 758B may be so configured as to output a signal to the second heater power source 756B for adjusting the temperature of the target material 270 in the tank 711 to a predetermined temperature based on the signal from the second temperature sensor 757B.

4.2 Operation

The target control device 803 may be so configured as to send a signal to the first and second temperature controllers 754B and 758B in a state in which the pressure inside of the chamber 2 is adjusted to a pressure capable of generating EUV light. Upon receiving this signal, the first and second temperature controllers 754B and 758B may start to control the electric power supplied to the first and second heater power sources 752B and 756B based on the signals from the first and second temperature sensors 753B and 757B, respectively. In this case, the first and second temperature controllers 754B and 758B may control the first and second heater power sources 752B and 756B so that the temperature of the target material 270 in the target generator 71 rises beyond its melting point. A temperature beyond the melting point of the target material 270 may be equal to or greater than 232° C. in the case of the target material 270 being tin, equal to or greater than 1312° C. in the case of gadolinium, and equal to or greater than 1356° C. in the case of terbium.

In order to suppress the separation of oxidants of the target material 270 near the nozzle hole, the target control device 80B may control the first and second temperature controllers 754B and 758B so that the temperature of the nozzle 712 is higher than that of the tank 711.

Thereafter, the target control device 80B may control the pressure adjuster 72, the piezoelectric driver 74A, and the like so that the droplets are outputted from the target generator 71. EUV light may be generated by irradiating the droplets with a laser beam.

5. Target material Refinement Device

5.1 Terms

Hereinafter, setting a temperature toward the leading end of a nozzle to be higher than a temperature at the other end side of the nozzle may be referred to as "applying a temperature gradient in the axial direction".

The upper portion above the target material of the sealed space in the refinement tank may be referred to as a "gas space".

5.2 First Embodiment

5.2.1 Outline

According to a first embodiment of the present disclosure, a target material refinement device may include a refinement tank, a heating section, a reduction section, and an exhaust section. The reduction section may reduce oxygen atoms present in the target material. The exhaust section may evacuate the sealed space.

With the configuration described above, the target material refinement device may generate water vapor by reducing oxygen atoms present in the target material and discharge the water vapor from the sealed space. As a result, oxygen atoms contained in the target material may be decreased. Accordingly, in the case where this target material is used for the generation of EUV light, it is possible to suppress the separation of oxidants of the target material.

5.2.2 Solubility of Oxygen Atoms in Tin

Figure 4:
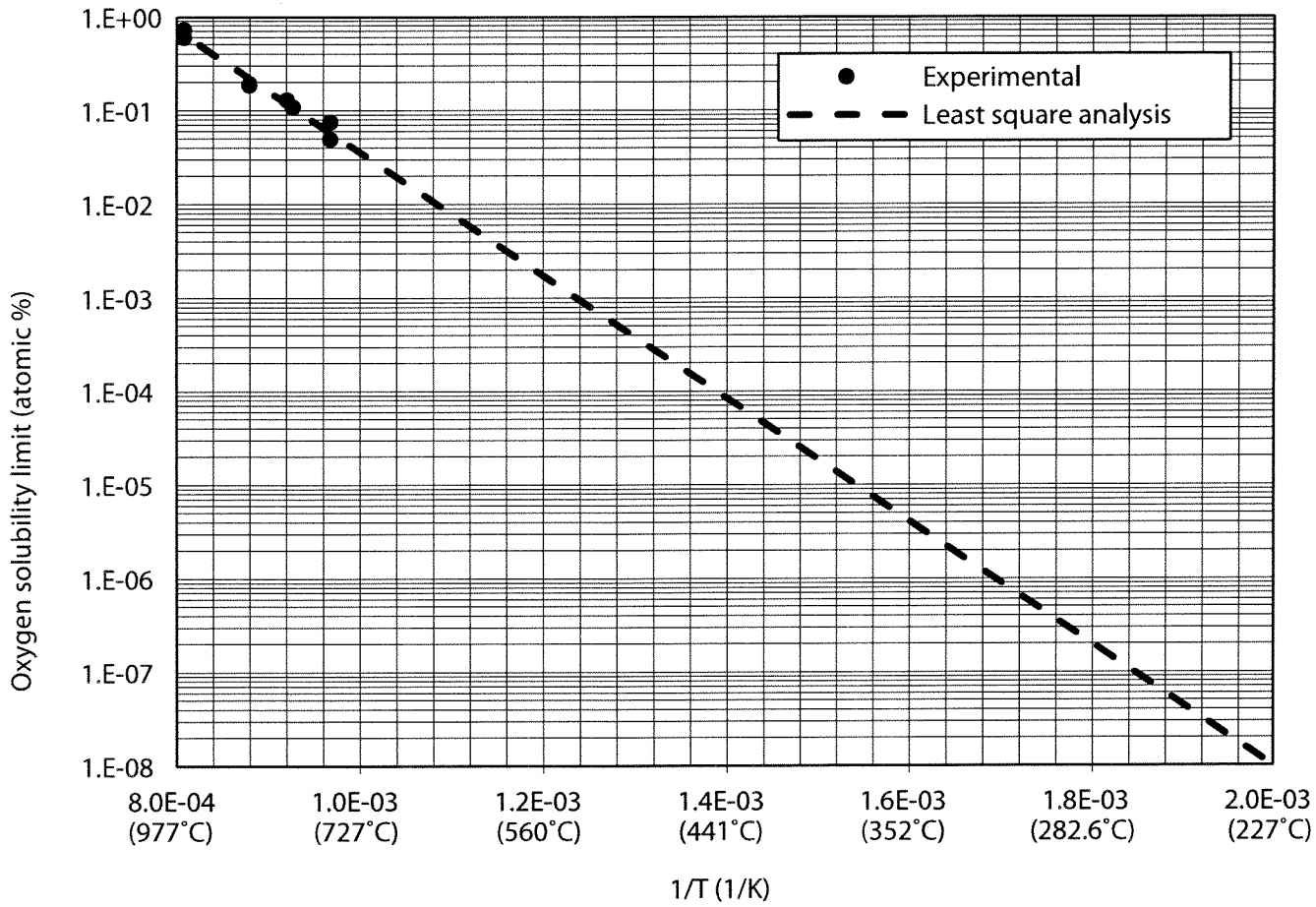
FIG. 4 is a graph illustrating the solubility of oxygen atoms in tin.

FIG. 4 is a graph illustrating the solubility of oxygen atoms in tin.

Oxygen atoms may be dissolved within the target material 270. In the case where the target material 270 is tin, the solubility of the oxygen atoms in tin may be lower as the temperature of the tin drops, as shown in FIG. 4. Accordingly, in the case where tin that has hardened after being heated to the first melting temperature is once again melted at the second melting temperature that is lower than the first melting temperature, an amount of oxygen atoms obtained by subtracting the second dissolving amount (the amount of oxygen atoms that can be dissolved into the tin at the second melting temperature) from the first dissolving amount (the amount of oxygen atoms that can be dissolved into the tin at the first melting temperature) cannot be dissolved into the tin. As a result, the oxygen atoms that cannot be dissolved may attach to the tin and separate as oxidized tin.

For example, when the solubility of oxygen atoms in liquid tin is expressed as S (atomic %) and the temperature of the liquid tin is expressed as T (K), the following equation (1) may be satisfied.

$$S=A\times\exp(B/T) \quad (1)$$

Here, $A=1.03\times10^{5}$, and $B=-1.48\times10^{4}$.

For example, in the case where the concentration of oxygen atoms contained in the tin is $1\times10^{-4}$ (atomic %), if the temperature of the tin is controlled to be 350° C., the solubility may be $5\times10^{-6}$ (atomic %).

Accordingly, the amount of tin oxidants that are separated may be a value corresponding to an amount of $95\times10^{-6}$ (atomic %) ($1\times10^{-4}-5\times10^{-6}$).

In other words, the separation of tin oxidants may be suppressed by controlling the temperature T of the liquid tin so that the following equation (2) is satisfied.

$$T(K)\geq B/\{\ln(S/A)\} \quad (2)$$

Here, $A=1.03\times10^{5}$, and $B=-1.48\times10^{4}$.

From the equation (2), for example, assuming that the rate of oxygen atoms present in the tin is lessened to $4\times10^{-7}$ (atomic %) it is possible to suppress the separation of tin oxidants by maintaining the temperature to be equal to or greater than 290° C. (563.1 K).

5.2.3 Configuration

Figure 5:
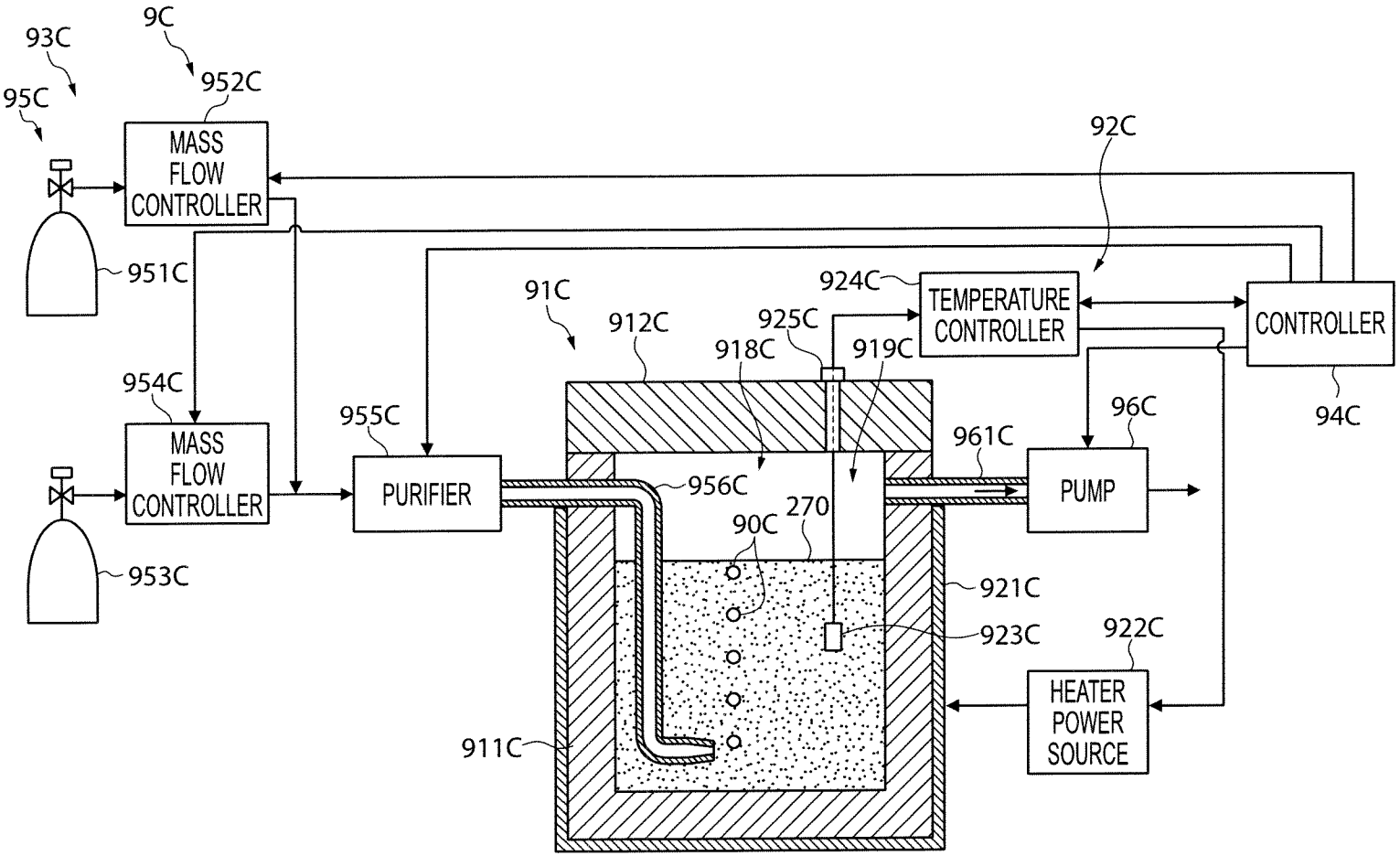
FIG. 5 is a schematic view illustrating the configuration of a target material refinement device according to a first embodiment.

FIG. 5 schematically illustrates the configuration of a target material refinement device according to the first embodiment.

As shown in FIG. 5, a target material refinement device 9C may include a refinement tank 91C, a heating section 92C, an oxygen-atom removing section 93C, and a controller 94C.

The refinement tank 91C may include a main tank body 911C and a lid 912C. The main tank body 911C may have a cylinder shape with its undersurface closed. The lid 912 may be approximately plate-shaped so as to cover the upper face of the main tank body 911C. The target material 270 may be accommodated in a sealed space 919C formed by the main tank body 911C and the lid 912C. The contact portion between the main tank body 911C and the lid 912C may be provided with a sealing member such as an O-ring (not shown) so as to enhance the sealing tightness of the sealed space 919C.

The main tank body 911C and the lid 912C may be made of a material that is unlikely to react with the target material 270 to produce an alloy. For example, in the case where the target material 270 is tin, the main tank body 911C and the lid 912C may be made of a material such as molybdenum, graphite, tungsten, or PBN (boron nitride produced by chemical vapor deposition). In the case where the main tank body 911C and the lid 912C are made of material that is likely to react with the target material 270, the inner surface of the main tank body 911C and the lower side surface of the lid 912C may be coated with molybdenum, graphite, tungsten or PBN.

A heating section 92C may include a heater 921C, a heater power source 922C, a temperature sensor 923C, and a temperature controller 924C.

The heater 921C may be provided on the outer circumferential surface and the lower surface of the main tank body 911C. The heater power source 922C may be electrically connected to the heater 921C and the temperature controller 924*c*. The heater power source 922C may supply electric power to the heater 921C to make the heater 921C emit heat based on a signal from the temperature controller 924C.

The temperature sensor 923C may be disposed so as to be in contact with the target material 270 in the main tank body 911C. The temperature sensor 923C may be connected to the temperature controller 924C via a feed-through 925C provided in the lid 912C. The temperature sensor 923C may detect the temperature of the target material 270 in the main tank body 911C and send a signal corresponding to the detected temperature to the temperature controller 924C.

The temperature controller 924C may be electrically connected to the controller 94C. The temperature controller 924C may be so configured as to determine, based on the signal from the temperature sensor 923C, the temperature of the target material 270 and output a signal to the heater power source 922C for adjusting the temperature of the target material 270 to a predetermined temperature.

The oxygen-atom removing section 93C may include a reduction section 95C and a pump 96C as the exhaust section.

The reduction section 95C may include a hydrogen gas tank 951C, a first mass flow controller 952*c*, an argon gas tank 953C, a second mass flow controller 954C, a purifier 955C, and a bubbling mechanism 956C.

The first mass flow controller 952C may be connected to the hydrogen gas tank 951C and the purifier 955C. Further, the first mass flow controller 952C may be electrically connected to the controller 94C. The first mass flow controller 952C may control the flow rate of hydrogen gas supplied from the hydrogen gas tank 951C and supply the controlled hydrogen gas to the purifier 955C. The second mass flow controller 954C may be connected to the argon gas tank 953C and the purifier 955C. The second mass flow controller 954C may be electrically connected to the controller 94C. The second mass flow controller 954C may control the flow rate of argon gas supplied from the argon gas tank 953C and supply the controlled argon gas to the purifier 955C.

The purifier 955C may be connected to the bubbling mechanism 956C. Further, the purifier 955C may be electrically connected to the controller 94C. The purifier 955C may be a line purifier that decreases the concentration of water and oxygen contained in the supplied gas. For example, the purifier 955C may have a configuration in which a filter that holds magnesium is heated and the filter and a gas are made to be in contact with each other, thereby removing oxygen from the gas made to be in contact with the filter.

The purifier 955C may be supplied with a reducing gas in which hydrogen gas and argon gas are mixed. The purifier 955C may decrease the concentration of water and oxygen contained in this reducing gas and supply the reducing gas to the bubbling mechanism 956C.

The bubbling mechanism 956C may be formed in a pipe shape. The bubbling mechanism 956C may be formed so that one end thereof is connected to the purifier 955*c* and the other end penetrates the main tank body 911C to be positioned at the lower end side of the main tank body 911C. The bubbling mechanism 956C may introduce a reducing gas whose contained amount of water and oxygen has been decreased into the molten target material 270 so as to generate bubbles 90C. When the bubbles 90C are generated, hydrogen atoms may be dissolved into the target material 270. The dissolved hydrogen atoms may reduce oxygen atoms in the target material 270, whereby water vapor may be generated. Then, the water vapor may be discharged into a gas space 918C in the sealed space 919C.

The pump 96C may be connected to a pipe 961C. The pipe 961C may communicate with the interior of the main tank body 911C so as to introduce a gas in the gas space 918C to the pump 96C. In addition, the pump 96C may be electrically connected to the controller 94C. The pump 96C may evacuate the gas space 918C based on a signal sent from the controller 94C. BY evacuating the gas space 918C, water vapor which has been generated through the reducing of the oxygen atoms in the target material 270, may be discharged to the exterior of the gas space 918C.

5.2.4 Operation

The target material refinement device 9C may decrease oxygen atoms in the target material 270 by performing the following process.

The controller 94C of the target material refinement device 9C may send to the temperature controller 924C a signal for heating the target material 270 to a predetermined temperature in a state in which the solid target material 270 is accommodated in the sealed space 919C of the refinement tank 91C.

In the case where the target material is tin and a portion of the refinement tank 91C that makes contact with the tin is formed of molybdenum or tungsten, the predetermined temperature may be equal to or greater than 232° C. and less than 370° C. If the temperature is less than 232° C., there exists a risk that the target material 270 will not be melted. Meanwhile, if the temperature is equal to or greater than 370° C., an alloy of tin and molybdenum or tungsten may be produced. In the case where the refinement tank 91C is made of graphite or PBN, the heating temperature of the target material 270 may be less than 1000° C. Graphite and PBN may be relatively chemically-stable at 1000° C. Further, since a temperature of 1000° C. is lower than the evaporation temperature of tin, evaporation of tin may be suppressed even if it is heated to 1000° C.

Upon receiving a signal from the controller 94C, the temperature controller 924C may send a control signal to the heater power source 922C so as to control the heat emission of the heater 921C. In this case, the temperature controller 924C may send the control signal to the heater power source 922C based on a signal from the temperature sensor 923C. The temperature controller 924C may determine that the target material 270 has been heated to a predetermined temperature and melted if the temperature specified by the signal from the temperature sensor 923C stays in a predetermine temperature range, which is above the melting point of the tin, for a set period of time, for example. In this case, the temperature controller 924C may maintain the molten state of the matter, and may send a melt completion signal to the controller 94C.

Upon receiving the melt completion signal, the controller 94C may send signals to the first and second mass flow controllers 952C and 954C, the purifier 955C, and the pump 96C so as to drive them. The first and second mass flow controllers 952C and 954C that have received the above signals may control the flow rate of hydrogen gas and argon gas to produce a reducing gas. The concentration of hydrogen gas in this reducing gas may be adjusted to be equal to or greater than 3% and equal to or less than 5%.

This reducing gas may experience processing in which the concentration of water and oxygen is decreased by the purifier 955C, and thereafter may be introduced into the target material 270 via the bubbling mechanism 956C. Subsequently, the oxygen atoms in the target material 270 are reduced by the reducing gas, and then water vapor may be discharged to the gas space 918C. The pump 96C may evacuate the gas space 918C so as to discharge the water vapor. Through the process described above, the oxygen atoms in the target material 270 may be decreased in quantity.

As described above, the target material refinement device 9C may introduce a reducing gas into the target material 270 in the refinement tank 91C, reduce the oxygen atoms in the target material 270, and discharge the water vapor, which is generated through the reduction, from the refinement tank 91C.

This may remove oxygen atoms contained in the target material 270, whereby the separation of oxidants of the target material 270 can be suppressed.

Further, with such a simple configuration in which a reducing gas is introduced into the target material 270, oxygen atoms in the target material 270 may be decreased.

Furthermore, by adjusting the introduction timing of the reducing gas and/or the concentration of hydrogen gas within the reducing gas, it is possible to adjust the removed amount and the removing speed of oxygen atoms. Accordingly, it is possible to appropriately decrease the oxygen atoms in accordance with the contained amount of oxygen which differs depending on production lots and storage conditions of the target material 270.

A gas that is introduced into the bubbling mechanism 956C is not limited to a mixture of hydrogen gas and argon gas, and only argon gas may be introduced. By introducing an inert gas that does not contain oxygen, such as argon gas or the like, into the bubbling mechanism 956C, oxygen may diffuse from the target material 270 to the inert gas at the boundary between the inert gas and the target material 270. This may decrease the oxygen atoms within the target material 270. In this case, the argon gas tank 953C may function as an inert gas supply section of the present invention. Moreover, carbon monoxide gas or methane gas may be introduced as a reducing gas. In the case where carbon monoxide gas is introduced, oxygen atoms are reduced and in turn carbon dioxide gas may be produced. Meanwhile, in the case where methane gas is introduced, oxygen atoms are reduced and in turn water and carbon dioxide gas may be produced.

5.3 Second Embodiment

5.3.1 Outline

According to a second embodiment of the present disclosure, a target material refinement device may reduce oxygen atoms in a target material using a solid reducing agent disposed in a refinement tank. Further, a gas that is produced through the reduction may be discharged from the refinement tank.

With the configuration described above, oxygen atoms contained in the target material may be removed.

5.3.2 Configuration

Figure 6:
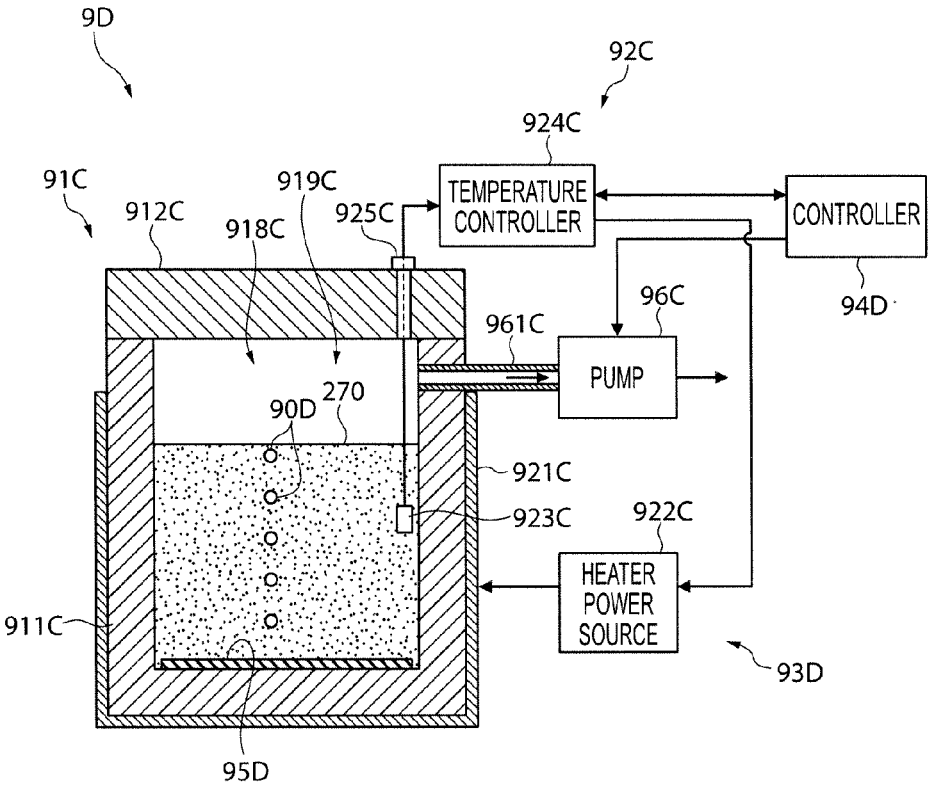
FIG. 6 is a schematic view illustrating the configuration of a target material refinement device according to a second embodiment.

FIG. 6 schematically illustrates the configuration of a target material refinement device according to the second embodiment.

As shown in FIG. 6, a target material refinement device 9D of the second embodiment may differ from the target material refinement device 9C of the first embodiment in that an oxygen-atom removing section 93D and a controller 94D are configured in a different manner from the first embodiment.

The oxygen-atom removing section 93D may include graphite 95D and the pump 96C.

The graphite 95D may be formed in a plate shape and disposed on the bottom surface inside of the refinement tank 91C.

The controller 94D may be electrically connected to the temperature controller 924C and the pump 96C.

5.3.3 Operation

The target material refinement device 9D may decrease oxygen atoms contained in the target material 270 by performing the following process.

The controller 94D of the target material refinement device 9D may control the temperature controller 924C to heat the target material 270 to a predetermined temperature in a state in which the solid target material 270 is accommodated in the sealed space 919C where the graphite 95D is disposed. The controller 94D may drive the pump 96C upon receiving a melt completion signal, which indicates that the target material 270 has been melted, from the temperature controller 924C.

When the target material 270 is melted, oxygen atoms in the target material 270 may be reduced by the graphite 95D so as to generate carbon monoxide gas bubbles 90D. This carbon monoxide gas may be discharged to the gas space 918C. The pump 96C may evacuate the gas space 918C so as to discharge the carbon monoxide gas. Through the process described above, the oxygen atoms in the target material 270 may be decreased.

As described above, the target material refinement device 9D may reduce oxygen atoms in the target material 270 using the graphite 95D that is disposed inside the refinement tank 91C, and discharge the carbon monoxide gas generated through the reduction from the refinement tank 91C. With this, the oxygen atoms contained in the target material 270 may be removed.

Further, with such a simple configuration in which the graphite 95D is disposed inside the refinement tank 91C, oxygen atoms in the target material 270 may be decreased.

Note that the graphite 95D may be provided in the form of lumps, granules or powder. Further, the graphite 95D may be disposed on a side surface of the refinement tank 91C.

Solid reducing agents other than graphite may be used. For example, aluminum or silicon may be disposed inside the refinement tank 91C.

5.4 Third Embodiment

5.4.1 Outline

According to a third aspect of the present disclosure, a target material refinement device may include a refinement tank, a heating section, an oxygen partial-pressure adjusting section, and an exhaust section. The oxygen partial-pressure adjusting section may make an oxygen partial pressure in the sealed space lower than that in the target material. The exhaust section may evacuate the sealed space.

With the above configuration, oxygen atoms in the target material may be decreased due to the difference in oxygen partial pressure, and then the oxygen atoms may be discharged from the sealed space. As a result, the oxygen atoms contained in the target material may be decreased and the separation of oxidants may be suppressed.

5.4.2 Configuration

Figure 7:
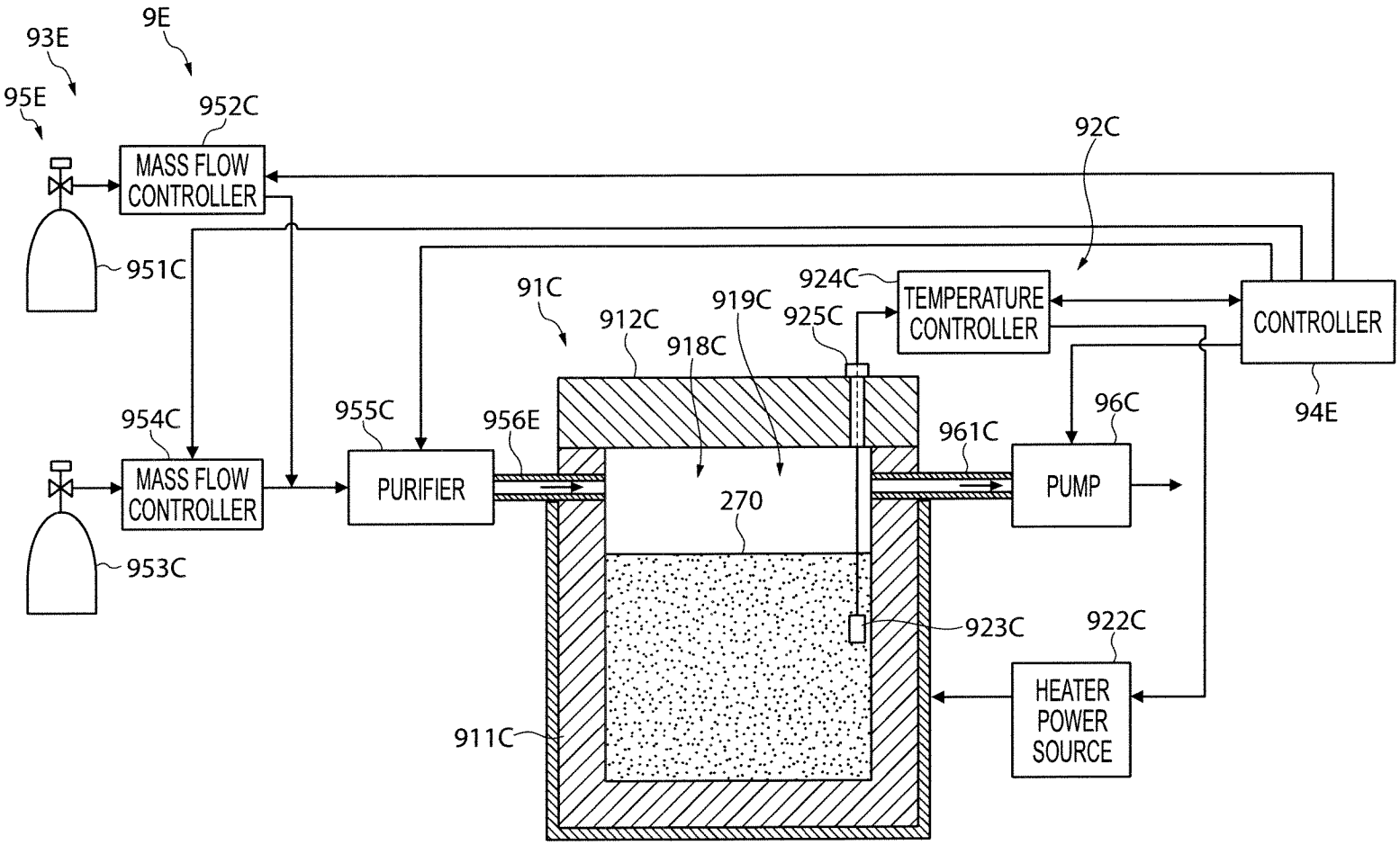
FIG. 7 is a schematic view illustrating the configuration of a target material refinement device according to a third embodiment.

FIG. 7 schematically illustrates the configuration of a target material refinement device according to the third embodiment.

As shown in FIG. 7, a target material refinement device 9E of the third embodiment may differ from the target material refinement device 9C of the first embodiment in that an oxygen-atom removing section 93E and a controller 94E are configured in a different manner from the first embodiment.

The oxygen-atom removing section 93E may include an oxygen-free gas supply section 95E as the oxygen partial-pressure adjusting section and the pump 96C.

The oxygen-free gas supply section 95E may include the hydrogen gas tank 951C, the first and second mass flow controllers 952C and 954C, the argon gas tank 953C, and the purifier 955C. In other words, the oxygen-free gas supply section 95E may include the constituent elements of the reduction section 95C except for the bubbling mechanism 956C.

The purifier 955C may be connected to one end of a pipe 956E. The pipe 956E may communicate with the interior of the main tank body 911C so that the other end thereof is positioned in the gas space 918C. The pipe 956E may introduce a reducing gas in which water and oxygen are decreased, or an oxygen-free gas into the gas space 918C. When the oxygen-free gas is introduced into the gas space 918C, the oxygen partial pressure in the gas space 918C becomes lower than that in the target material 270, whereby oxygen atoms in the target material 270 may diffuse into the gas space 918C.

5.4.3 Operation

The target material refinement device 9E may decrease oxygen atoms in the target material 270 by performing the following process.

The controller 94E of the target material refinement device 9E may control the temperature controller 924C to heat the target material 270 to a predetermined temperature in a state in which the solid target material 270 is accommodated in the sealed space 919C.

In this case, as the temperature of the target material 270 is higher, the vapor pressure of oxygen at the liquid level of the target material 270 may be higher. That is, in order to boost the decreased amount of oxygen atoms, the heating temperature may be raised as much as possible. For example, if only argon gas is introduced into the gas space 918C as the oxygen-free gas, the heating temperature may be set to 1000° C.

Meanwhile, in the case where a mixed gas of hydrogen gas and argon gas is introduced as the oxygen-free gas, because the reduction effect of hydrogen gas can be counted, the concentration of oxygen within the target material 270 may be decreased even at a temperature of equal to or greater than 300° C. and equal to or less than 370° C. In this embodiment, an oxygen-free gas in which the concentration of hydrogen gas is equal to or greater than 3% and equal to or less than 5% may be introduced.

Upon receiving the melt completion signal indicating that the target material 270 has been melted from the temperature controller 924C, the controller 94E may drive the first and second mass flow controllers 952C and 954C, the purifier 955C, and the pump 96C of the oxygen-free gas supply section 95E. Having received this signal, the first and second mass flow controllers 952C, 954C and the pump 96C may generate an oxygen-free gas in which the concentration of water and oxygen is decreased, and introduce it into the gas space 918C.

When the oxygen-free gas is introduced in the gas space 918C, the oxygen partial pressure in the gas space 918C may be lower than that in the target material 270. Then, the oxygen atoms in the target material 270 may be discharged into the gas space 918C, and subsequently discharged through the gas space 918C by the pump 96C. Through the above process, the oxygen atoms in the target material 270 may be decreased.

As described above, the target material refinement device 9E may introduce an oxygen-free gas into the gas space 918C so as to make the oxygen partial pressure in the gas space 918C lower than that in the target material 270.

With this, oxygen atoms contained in the target material 270 may be discharged to the exterior of the refinement tank 91C through the gas space 918C; thus the oxygen atoms in the target material 270 may be removed. Accordingly, it is possible to suppress the separation of oxidants of the target material 270.

Further, with such a simple configuration in which an oxygen-free gas is introduced into the target material 270, oxygen atoms in the target material 270 may be removed.

Furthermore, by adjusting the introduction time of the oxygen-free gas or the like, it is possible to adjust the removed amount of oxygen atoms. Accordingly, it is possible to appropriately decrease the oxygen atoms in accordance with the contained amount of oxygen which differs depending on production lots and storage conditions of the target material 270.

5.5 Fourth Embodiment

5.5.1 Outline

According to a fourth embodiment of the present disclosure, a target material refinement device may evacuate a sealed space in a refinement tank to be at a low pressure close to a vacuum state so as to make the oxygen partial pressure in the sealed space lower than that in the target material.

With the configuration described above, oxygen atoms contained in the target material may be decreased due to the difference in oxygen partial pressure (distribution) so as to be discharged from the sealed space. As a result, the oxygen atoms contained in the target material may be decreased and in turn the separation of the oxidants may be suppressed.

5.5.2 Configuration

Figure 8:
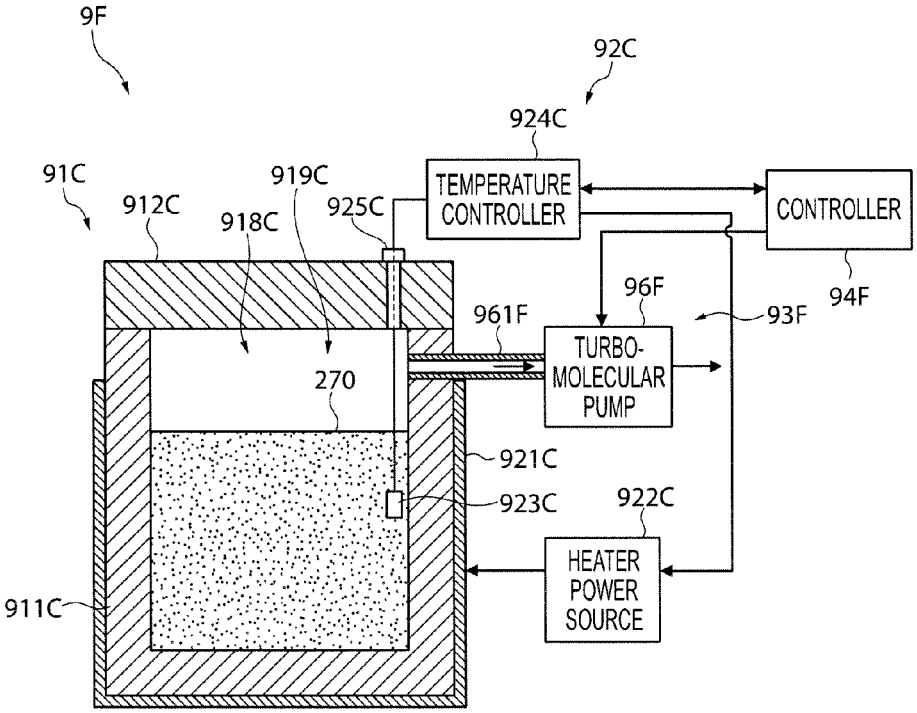
FIG. 8 is a schematic view illustrating the configuration of a target material refinement device according to a fourth embodiment.

FIG. 8 schematically illustrates the configuration of a target material refinement device according to the fourth embodiment.

As shown in FIG. 8, a target material refinement device 9F of the fourth embodiment may differ from the target material refinement device 9E of the third embodiment in that an oxygen-atom removing section 93F and a controller 94F are configured in a different manner from the third embodiment.

The oxygen-atom removing section 93F may include a turbo-molecular pump 96F as the exhaust section configuring the oxygen partial-pressure adjusting section. The turbo-molecular pump 96F may be connected to a pipe 961F. The pipe 961F may communicate with the interior of the main tank body 911C so that a gas in the gas space 918C can be discharged by the turbo-molecular pump 96F through the pipe 961F. In addition, the turbo-molecular pump 96F may be electrically connected to the controller 94F. The turbo-molecular pump 96F may evacuate the gas space 9180 to be at a low pressure close to a vacuum state based on a signal sent from the controller 94F. For example, the turbo-molecular pump 96F may evacuate the space to attain a degree of vacuum of $1\times10^{-10}$ Pa. By making the gas space 918C at a low pressure close to a vacuum state, the oxygen partial pressure in the gas space 918C becomes lower than that in the target material 270, thereby making it possible for the oxygen atoms in the target material 270 to be discharged to the exterior of the refinement tank 91C via the gas space 918C. Note that the turbo-molecular pump 96F may be equipped with an appropriate backing pump.

5.5.3 Operation

The target material refinement device 9F may decrease oxygen atoms in the target material 270 by performing the following process.

The controller 94F of the target material refinement device 9F may control the temperature controller 924C to heat the target material 270 to a predetermined temperature in a state in which the solid target material 270 is accommodated in the sealed space 919C. The controller 94F may bake the refinement tank 91C so as to decrease water, oxygen and the like adhering to an inner wall of the refinement tank 91C before the solid target material 270 is accommodated in the sealed space 919C.

Upon receiving the melt completion signal indicating that the target material 270 has been melted from the temperature controller 924C, the controller 94F may drive the turbo-molecular pump 96F to evacuate the gas space 918C so as to make it in a vacuum state. Alternatively, the controller 94F may start driving of the turbo-molecular pump 96F during the processing in which the target material 270 is being heated.

When the gas space 918C is evacuated, the oxygen partial pressure in the gap space 918C is lower than that in the target material 270, whereby the oxygen atoms in the target mater 270 may be discharged by the turbo-molecular pump 96F via the gas space 918C. In this case, it is advisable that the gas space 918C be evacuated by the turbo-molecular pump 96F to be at a low pressure close to a vacuum state. For example, the space may be evacuated to attain a degree of vacuum of $1\times10^{-10}$ Pa. Through the process described above, the oxygen atoms in the target material 270 may be decreased.

As described above, the target material refinement device 9F may evacuate the gas space 918C to be at a low pressure close to a vacuum state so that the oxygen partial pressure in the gas space 918C becomes lower than that in the target material 270.

Through this, oxygen atoms contained in the target material 270 may be discharged to the exterior of the refinement tank 91C via the gas space 918C; consequently the oxygen atoms in the target material 270 may be decreased. Accordingly, it is possible to suppress the separation of oxidants of the target material 270.

5.6 Fifth Embodiment

5.6.1 Outline

According to a fifth embodiment of the present disclosure, a target material refinement device may cause oxidants that are formed of oxygen atoms and other elements to be separated and thereafter remove these oxidants.

With the above configuration, oxygen atoms contained in the target material may be removed in the form of oxidants. As a result, unfavorable separation of oxidants may be suppressed.

5.6.2 Configuration

Figure 9:
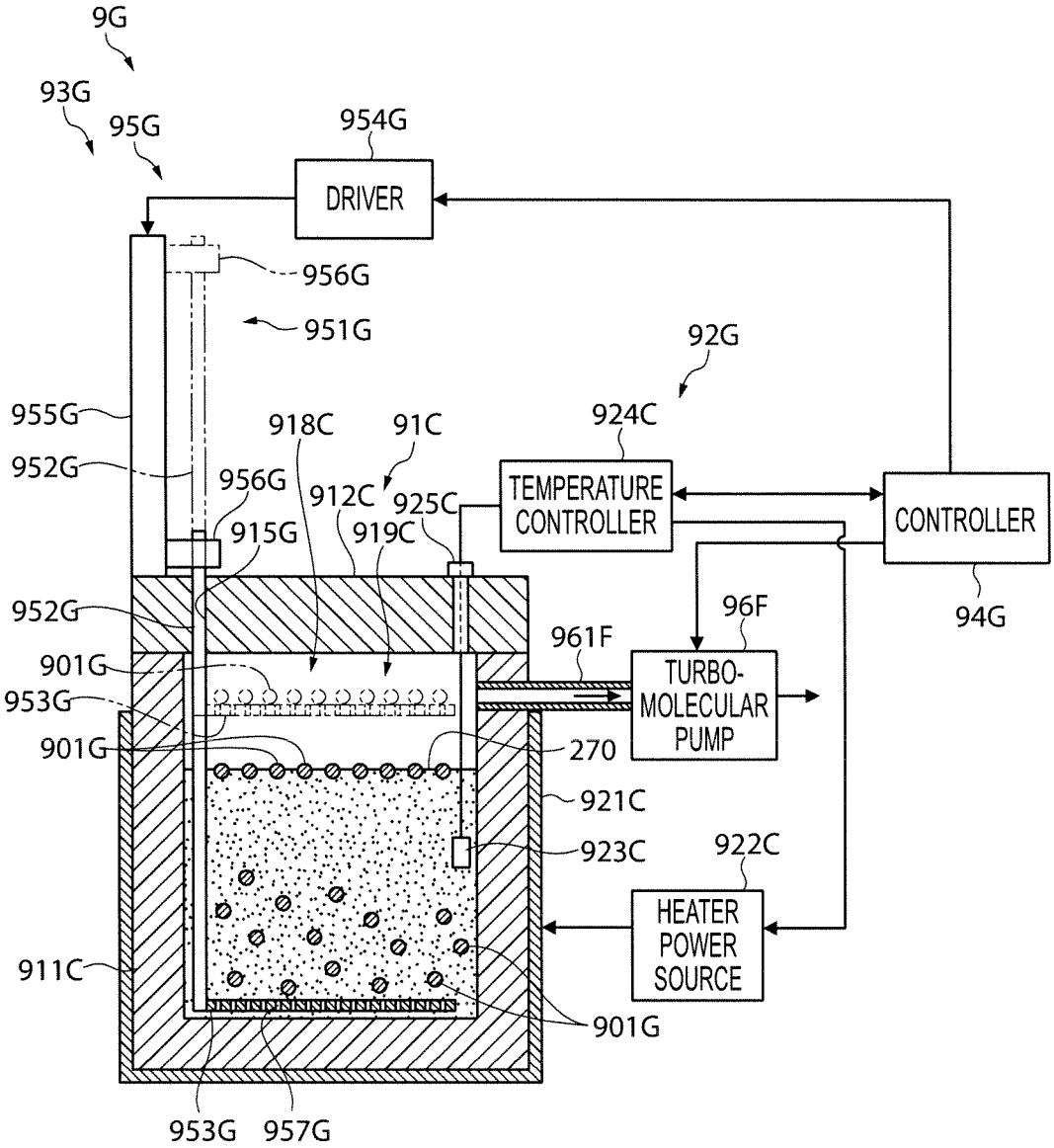
FIG. 9 is a schematic view illustrating the configuration of a target material refinement device according to a fifth embodiment.

FIG. 9 schematically illustrates the configuration of a target material refinement device according to the fifth embodiment.

As shown in FIG. 9, a target material refinement device 9G of the fifth embodiment may differ from the target material refinement device 9F of the fourth embodiment in that an oxygen-atom removing section 93G and a controller 94G are configured in a different manner from the fourth embodiment.

The target material refinement device 9G may include the refinement tank 91C, the oxygen-atom removing section 93G, and the controller 94G. The oxygen-atom removing section 93G may include a heating section 92G as a separating section and an oxidant removing section 95G. The heating section 92G may have the same configuration as the heating section 92C.

The oxidant removing section 95G may include a one-axis stage 951G, a shaft 952G, a mesh filter 953G, and a driver 954G. The one-axis stage 951G may include a main stage body 955G extending upward from the upper surface of the lid 912C, and a slider 956G that is moved upward and downward by a driving mechanism mounted in the main stage body 955G. The main stage body 955G may be electrically connected to the driver 954G. The main stage body 955G may move the slider 956G upward or downward based on a signal from the driver 954G.

The upper end side of the shaft 952G may be fixed to the slider 956G and the lower end side thereof may be fixed to the mesh filter 953G located in the sealed space 919C. The shaft 952G may pass through a through-hole 915G in the lid 912C. The through-hole 915G may be provided with a seal unit (not shown) so as to maintain sealing tightness of the sealed space 919C even when the shaft 952G is moved upward and downward.

The mesh filter 953G may be fixed to the lower end of the shaft 952G. The mesh filter 953G may have a plurality of openings 957G. A cross-section area of the opening 957G may be smaller than that of the nozzle hole of the nozzle 712 of the target generator 71.

The driver 954G may be electrically connected to the controller 94G.

5.6.3 Operation

The target material refinement device 9G may decrease oxygen atoms in the target material 270 by performing the following process.

First, the mesh filter 953G is positioned near the bottom of the sealed space 919C and the solid target material 270 is accommodated in the sealed space 919C. While being in the above state, the controller 94G of the target material refinement device 9G may control the temperature controller 924C of the heating section 92G to heat the target material 270 to a predetermined temperature.

In this case, the temperature of the target material 270 may be the second melting temperature, which is lower than the first melting temperature. The second melting temperature may be equal to or greater than 232° C. and equal to or less than 370° C.

For example, as shown in FIG. 4 and the equation (2) described earlier, in the case where tin as the target material 270 is melted at 350° C., the solubility of oxygen atoms may be $5\times10^{-6}$ (atomic %). Accordingly, if more than $5\times10^{-6}$ (atomic %) oxygen atoms are included in the pre-melted target material 270, oxidants of the tin may be separated as separated oxidants 901G.

Upon receiving the melt completion signal indicating that the target material 270 has been melted from the temperature controller 924C, the controller 94G may drive the turbo-molecular pump 96F to evacuate the gas space 918C to be at a low pressure close to a vacuum state. When the gas space 918C is evacuated, oxygen atoms in the target material 270 may be discharged by the turbo-molecular pump 96F through the gas space 918C. Through the process described above, the oxygen atoms in the target material 270 may be decreased.

In addition, the controller 94G, upon receiving the melt completion signal, may send a removal-start signal to the driver 954G. The removal-start signal may be a signal to move the mesh filter 953G located in the target material 270 up to the gas space 9180. Upon receiving the removal-start signal, the driver 954G may drive the one-axis stage 951G to lift the mesh filter 953G in the target material 270. The driver 954G may stop the lifting of the mesh filter 953G when the mesh filter 953G has reached the gas space 918C. The separated oxidants 901G that are larger in size than the opening 957G may be removed from the target material 270 during the mesh filter 953G being lifted.

Next, the controller 94G may control the temperature controller 924C of the heating section 92G to lower the temperature of the target material 270. The target material 270 may harden when the temperature of the target material 270 becomes lower than its melting point.

Thereafter, the hardened target material 270 may be reheated and melted to be used for the generation of EUV light.

Here, under a condition that tin as the target material 270 is heated to 350° C., the rate of oxygen atoms in the refined target material 270 may be equal to or less than $5\times10^{-6}$ (atomic %) if the separated oxidants 901G have been almost completely removed by the mesh filter 953G. In this case, by performing heat control such that the target material 270 is maintained at a temperature of equal to or greater than 350° C. in the target generator, the separation of oxidants of the target material 270 may be suppressed.

Therefore, in order to make the rate of oxygen atoms contained in the refined target material 270 further smaller, the above-described process may be performed in a state in which the target material 270 of tin is heated to the melting point (232° C.). As shown in FIG. 4 and the equation (2) described earlier, the solubility of the oxygen atoms in the target material 270 at 232° C. may be $1.93\times10^{-9}$ (atomic %). The amount of separated oxidants 901G when the target material 270 is heated to 232° C. is larger than that when the target material 270 is heated to 350° C., and the oxygen atoms in the refined target material 270 may be more decreased in quantity by removing the above-mentioned separated oxidants 901G with the mesh filter 953G.

Since the specific gravity of the separated oxidant 901G (tin oxide) is smaller in comparison with the liquid target material 270, the separated oxidants 901G can float on the liquid surface. The separated oxidants 901G floating on the surface may also be removed with the mesh filter 953G.

As described above, the target material refinement device 9G may control the melting temperature of the target material 270, make the oxidants be separated as the separated oxidants 901G, and remove the separated oxidants 901G from the target material 270.

Accordingly, with such a simple configuration in which the melting temperature is controlled, it is possible to remove oxygen atoms in the form of the separated oxidants 901G so as to decrease the oxygen atoms in the target material 270. This makes it possible to suppress the separation of oxidants of the target material 270.

In the above process, the melting of the target material 270 is started in a state in which the mesh filter 953G is positioned near the bottom of the sealed space 919C; however, the following process may be performed. That is, the target material 270 may be melted in a state in which the mesh filter 953G is positioned in the gas space 918C. Then, the mesh filter 953G may be lowered down to the vicinity of the bottom of the sealed space 919C, thereafter, the temperature of the target material 270 may be made lower than the initial melting temperature and higher than the melting point so as to obtain the separated oxidants 901G. These separated oxidants 901G may be removed with the mesh filter 953G.

5.7 Sixth Embodiment

5.7.1 Outline

According to a sixth embodiment of the present disclosure, a target material refinement device may put particles of silicon (Si) as gettering substances into a liquid target material, for example. Since the gettering substance is an element that is coupled to oxygen atoms, a silica ($SiO_2$) film may be formed on the surface of the gettering substance. Then, the gettering substance on which the silica film is formed may be removed.

With the configuration described above, oxygen atoms contained in the target material may be removed. As a result, the separation of oxidants may be suppressed when the target material is used for the generation of EUV light.

5.7.2 Configuration

Figure 10A:
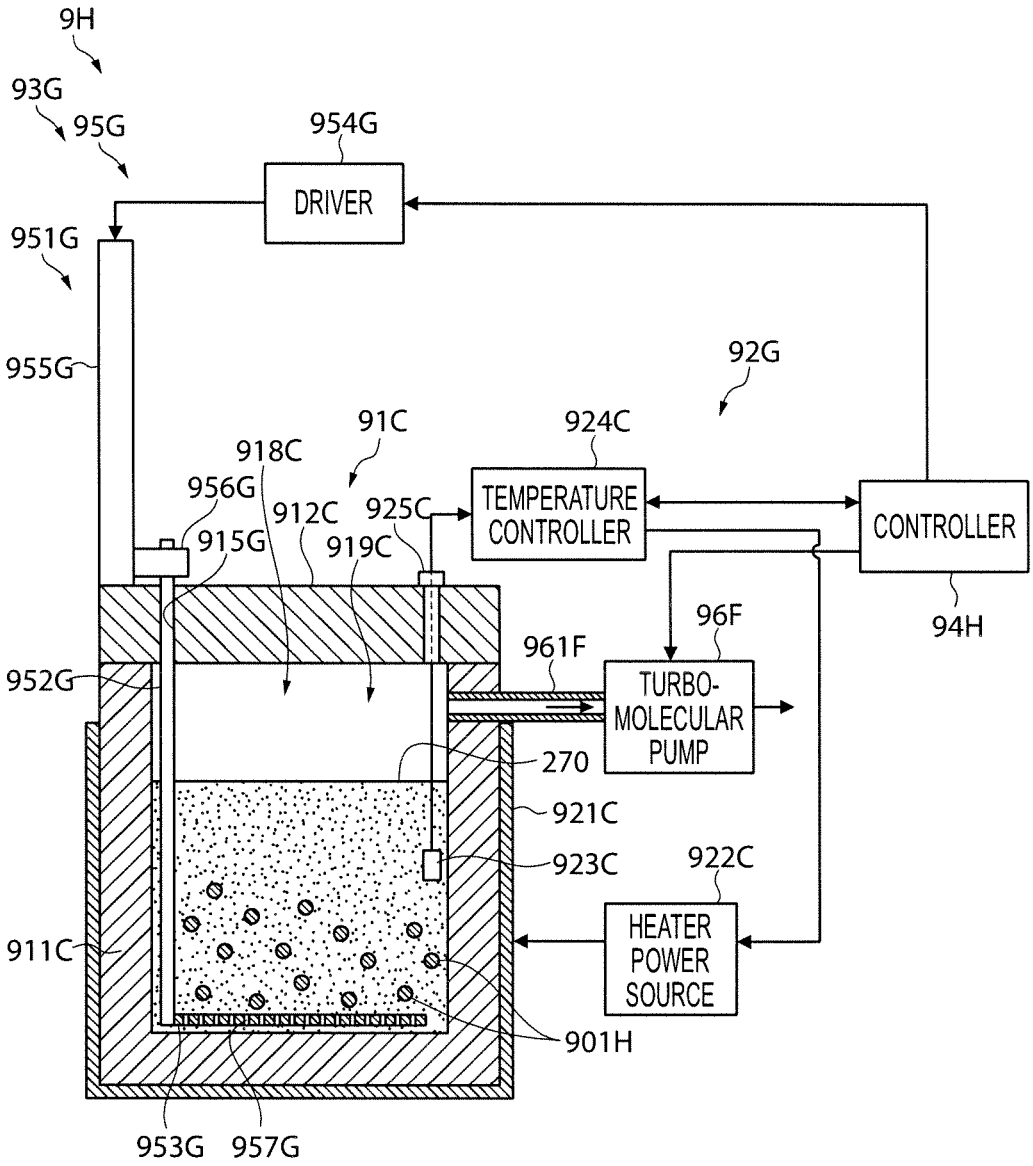
FIG. 10A is a schematic view illustrating the configuration of a target material refinement device according to a sixth embodiment, specifically showing a state in which gettering substances are not coupled to oxygen atoms.
Figure 10B:
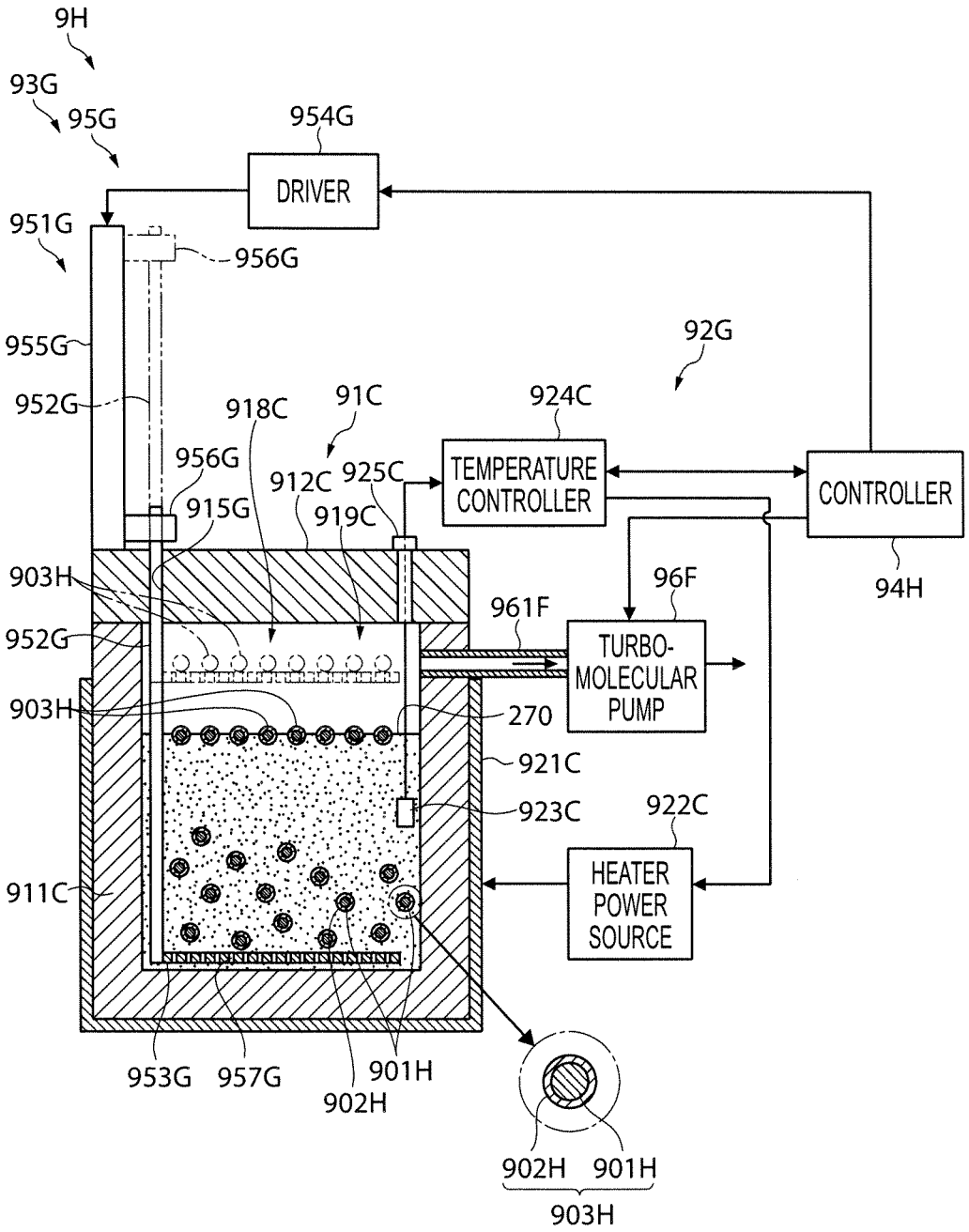
FIG. 10B is a schematic view illustrating the configuration of the target material refinement device according to the sixth embodiment, specifically showing a state in which gettering substances are coupled to oxygen atoms.

FIG. 10A schematically illustrates the configuration of a target material refinement device according to the sixth embodiment, specifically showing a state in which gettering substances are not coupled to oxygen atoms. FIG. 10B also schematically illustrates the configuration of the target material refinement device according to the sixth embodiment, specifically showing a state in which gettering substances are coupled to oxygen atoms.

As shown in FIG. 10A, a target material refinement device 9H of the sixth embodiment may differ from the target material refinement device 9G of the fifth embodiment in that there may exist gettering substances 901H in the sixth embodiment.

5.7.3 Operation

The target material refinement device 9H may decrease oxygen atoms in the target material 270 by performing the following process.

The gettering substances 901H and the solid target material 270 may be stored in the sealed space 919C in a state in which the mesh filter 953G is positioned near the bottom of the sealed space 919C. It is advisable for the gettering substance 901H to have such a size that will not pass through the opening 957G of the mesh filter 953G. Next, a controller 94H may control the temperature controller 924C to heat the target material 270 to the second melting temperature.

The controller 94H, upon receiving the melt completion signal indicating that the target material 270 has been melted from the temperature controller 924C, may drive the turbomolecular pump 96F to evacuate the gas space 918C to make it in a vacuum state so as to discharge the oxygen atoms in the target material 270 from the refinement tank 91C. Through the process described above, the oxygen atoms in the target material 270 may be decreased. Further, as shown in FIG. 10B, the oxygen atoms in the target material 270 may be coupled to the gettering substances 901H so as to form silica films 902H on the surfaces of the gettering substances 901H. Hereinafter, the gettering substance 901H on which the silica film 902H is formed will be referred to as a removal-target object 903H in some case.

Upon receiving the melt completion signal, the controller 94H may lift the mesh filter 953G and may stop the lifting of the mesh filter 953G when the mesh filter 953G has reached the gas space 918C, as shown in FIG. 10B. The removal-target object 903H that is larger in size than the opening 957G may be removed from the target material 270 with the mesh filter 953G during the time in which the mesh filter 953G is being lifted.

Next, the controller 94H may control the temperature controller 924C to lower the temperature of the target material 270. When the temperature of the target material 270 becomes lower than its melting point, the target material 270 may start to harden.

Thereafter, the hardened target material 270 may be reheated and melted to be used for the generation of EUV light.

As described above, the target material refinement device 9H may generate the removal-target objects 903H by making the gettering substances 901H capture the oxygen atoms in the liquid target material 270, and discharge the generated removal-target objects 903H from the target material 270.

Accordingly, with such a simple configuration in which the target material 270 is melted, it is possible to remove oxygen atoms in the form of the removal-target objects 903H so as to decrease the oxygen atoms in the target material 270. Therefore, the separation of oxidants of the target material 270 can be suppressed.

Note that any element that is coupled to oxygen atoms may be employed as the gettering substance 901H; for example, aluminum may be employed.

A gettering substance supply apparatus that can supply the gettering substances 901H to the sealed space 919C from the exterior of the refinement tank 91C, may be additionally provided.

6. EUV Light Generation Apparatus Including Target Material Refinement Device

6.1 Seventh Embodiment

6.1.1 Outline

According to a seventh embodiment of the present disclosure, a target supply apparatus included in an EUV light generation apparatus, may have a target material refinement device for decreasing oxygen atoms in a target material and a nozzle for outputting the target material in which the oxygen atoms have been decreased by the target material refinement device into a chamber.

With the above configuration, even if a large number of oxygen atoms are contained in a solid target material, the target supply apparatus can suppress the separation of oxidants of the target material, whereby a nozzle hole may be prevented from being clogged with the oxidants. This may suppress change in the output direction of the target material, which is likely to occur when oxidants accumulate in the nozzle hole.

Further, even if the oxygen atoms in the target material increase due to the oxygen atoms present in the refinement tank, for example, the target supply apparatus can remove and decrease those oxygen atoms, whereby the separation of the oxidants may be suppressed.

6.1.2 Configuration

Figure 11:
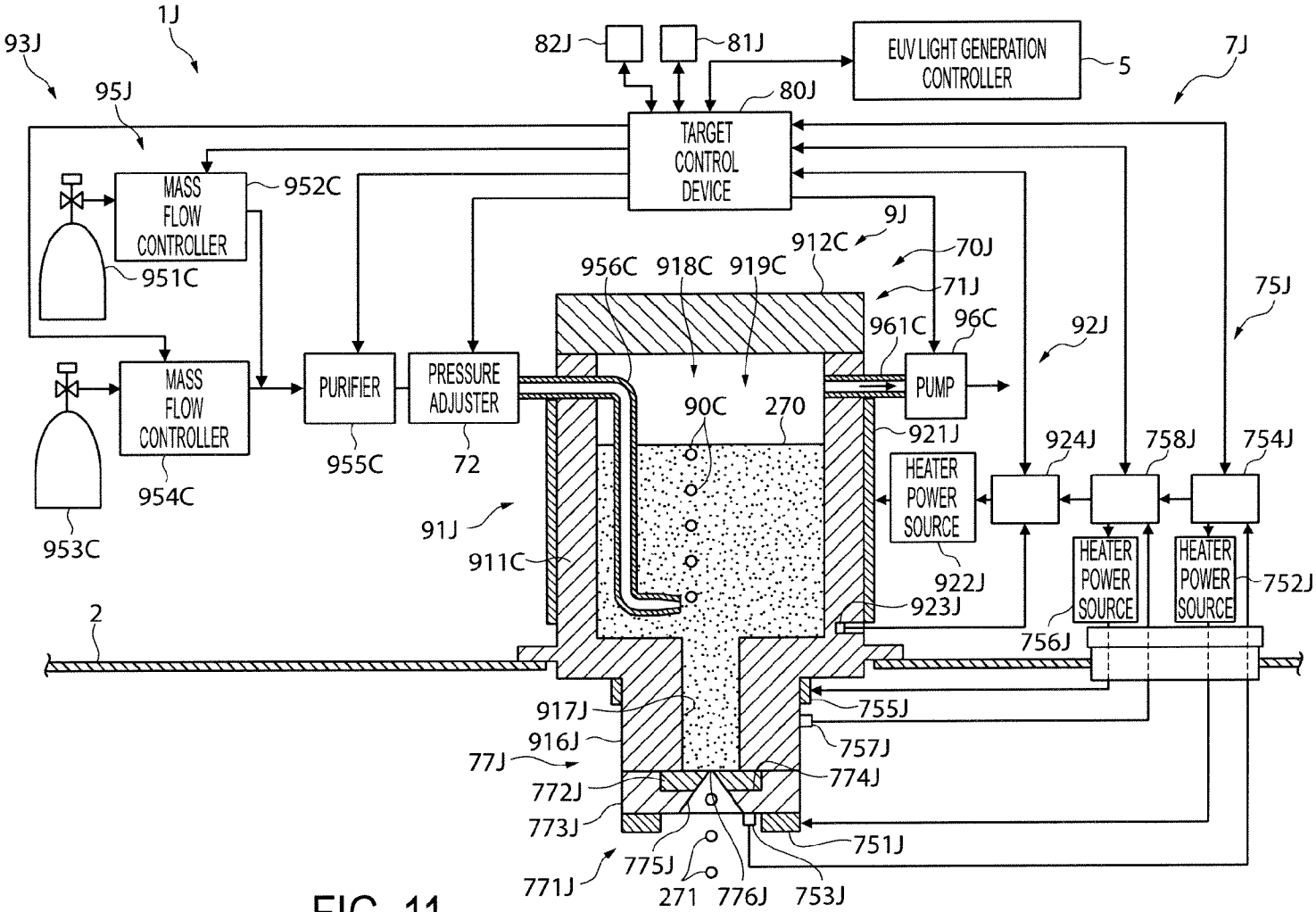
FIG. 11 is a schematic view illustrating the configuration of an EUV light generation apparatus including a target material refinement device according to a seventh embodiment.

FIG. 11 schematically illustrates the configuration of an EUV light generation apparatus including a target material refinement device according to the seventh embodiment.

An EUV light generation apparatus 1J according to the seventh embodiment may include a target material refinement device 9J similar to the target material refinement device 9C of the first embodiment. The EUV light generation apparatus 1J may generate EUV light using the target material 270 refined by the target material refinement device 9J.

As shown in FIG. 11, the EUV light generation apparatus 1J may include the chamber 2, the EUV light generation control system 5, and a target supply apparatus 7J. The target supply apparatus 7J may include a target generation section 70J and a target control device 80J.

The target generation section 70J may include a target generator 71J, the pressure adjuster 72, and a temperature adjustment section 75J. Further, the target generation section 70J may include the piezoelectric driver 74A as shown in FIG. 2, although the illustration and the description thereof are omitted here.

The target generator 71J may include the target material refinement device 9J to refine the target material 270. The target material refinement device 9J may include a refinement tank 91J, a heating section 92J, and an oxygen-atom removing section 93J.

A nozzle 77J for outputting the target material 270 in the main tank body 911C into the chamber 2, may be provided in the refinement tank 91J. The nozzle 77J may be disposed inside of the chamber 2. The nozzle 77J may include a main nozzle body 916J extending downward from the center of the bottom of the main tank body 911C, and a nozzle tip portion 771J attached to the tip of the main nozzle body 916J.

The main nozzle body 916J may be formed in a cylinder shape. A hollow portion of the main nozzle body 916J may be a through-hole 917J for introducing the target material 270 in the main tank body 911C to the nozzle tip portion 771J.

The nozzle tip portion 771J may be equipped with a hole formation member 772J and a fixing member 773J.

The hole formation member 772J may be formed in a plate shape and may have a conical hole 775J in the center thereof. The conical hole 775J may be cone-shaped such that the diameter thereof is larger as it proceeds from the upper side to the lower side in the drawing. A nozzle hole 776J may be formed on the upper end of the conical hole 775J. For example, the diameter of the nozzle hole 776J may be equal to or greater than 6 μm and equal to or less than 30 μm. The fixing member 773J may be formed in a plate shape and may have a fitting recess 774J on the upper surface thereof. The fitting recess 774J may be the same in shape as the hole formation member 772J so as to fit the hole formation member 772J thereinto. The fitting recess 774J may be formed so that the depth thereof is equal to or slightly less than the thickness of the hole formation member 772J.

The nozzle tip portion 771J may be anchored to the lower surface of the main nozzle body 916J with a bolt (not shown) or the like. In this case, the nozzle tip portion 771J may be anchored so that the center of the nozzle hole 776J is positioned on the central axis of the main nozzle body 916J and the hole formation member 772J and the fixing member 773J are adhered tightly to the main nozzle body 916J.

The hole formation member 772J and the fixing member 773J may be formed with a material whose coefficient of thermal expansion is approximately the same as the material of the refinement tank 91J. By forming the hole formation member 772J, the fixing member 773J and the refinement tank 91J with the materials having approximately the same coefficient of thermal expansion, the sealing property between the hole formation member 772J, the fixing member 773J and the main nozzle body 916J may be easily maintained even when the temperature of the target material 270 goes up. The hole formation member 772J, the fixing member 773J and the refinement tank 91J may be formed with the same material, and may be formed with, for example, molybdenum or tungsten.

A first timer 81J and a second timer 82J may be electrically connected to the target control device 80J.

The heating section 92J may include a third heater 921J, a third heater power source 922J, a third temperature sensor 923J, and a third temperature controller 924J. The third heater 921J may be provided only on the outer circumferential surface of the main tank body 911C. The third temperature sensor 923J may be provided at a position which is on the outer circumferential surface of the main tank body 911C and is on a side of the third heater 921J closer to the vicinity of the nozzle 77J. The third temperature sensor 923J may be disposed in a recess that is provided on the outer circumferential surface of the main tank body 911C so as to be capable of detecting the temperature of a portion near the target material 270 in the main tank body 911C.

The oxygen-atom removing section 93J may be equipped with a reduction section 95J and the pump 96C.

The purifier 955C of the reduction section 95J may be connected to the pressure adjuster 72. The purifier 955C may supply a mixed gas of a reducing gas in which the concentration of water and oxygen is decreased and an argon gas to the pressure adjuster 72. One end of the bubbling mechanism 956C may be connected to the pressure adjuster 72. The bubbling mechanism 956C may introduce the mixed gas of the reducing gas and the argon gas supplied from the pressure adjuster 72 into the target material 270.

The temperature adjustment section 75J may include a first heater 751J, a second heater 755J, a first heater power source 752J, a second heater power source 756J, a first temperature sensor 753J, a second temperature sensor 757J, a first temperature controller 754J, and a second temperature controller 758J.

The first heater 751J may be provided along an outer edge of the lower surface of the fixing member 773J. The first heater 751J may mainly heat the hole formation member 772J and the fixing member 773J.

The first heater power source 752J may be electrically connected to the first heater 751J and the first temperature controller 754J, and may supply electric power to the first heater 751J based on a signal from the first temperature controller 754J.

The first and second temperature sensors 753J and 757J may be electrically connected to the first and second temperature controllers 754J and 758J, respectively.

The first temperature sensor 753J may be disposed on the inner side of the first heater 751J (conical hole 775J side) on the lower surface of the fixing member 773J. The first temperature sensor 753J may mainly detect the temperature of the nozzle tip portion 771J and send a signal corresponding to the detected temperature to the first temperature controller 754J. Here, because the nozzle hole 776J is provided on the upper face of the nozzle tip portion 771J, it is possible to heat the target material 270 being positioned on the periphery of the nozzle hole 776J by heating the nozzle tip portion 771J. Detecting the temperature of the nozzle tip portion 771J makes it possible to determine a temperature of the periphery of the nozzle hole 776J.

The second heater 755J may be provided on the outer circumferential surface of the main nozzle body 916J.

The second heater power source 756J may be electrically connected to the second heater 755J and the second temperature controller 758J, and may supply electric power to the second heater 755J based on a signal from the second temperature controller 758J.

The second temperature sensor 757J may be disposed on a side of the second heater 755J closer to the vicinity of the nozzle 77J. The second temperature sensor 757J may mainly detect the temperature of the main nozzle body 916J (a value close to the temperature of the target material 270 within the main nozzle body 916J), and may send a signal corresponding to the detected temperature to the second temperature controller 758J.

The first and second temperature controllers 754J and 758J may be electrically connected to the target control device 80J. The first temperature controller 754J may be so configured as to determine a temperature of the periphery of the nozzle hole 776J based on the signal from the first temperature sensor 753J and output a signal to the first heater power source 752J for adjusting the temperature of the periphery of the nozzle hole 776J to a predetermined temperature. The second temperature controller 758J may be so configured as to determine a temperature of the target material 270 within the main nozzle body 916J based on the signal from the second temperature sensor 757J and output a signal to the second heater power source 756J for adjusting the temperature of the target material 270 to a predetermined temperature.

6.1.3 Operation

Figure 12:
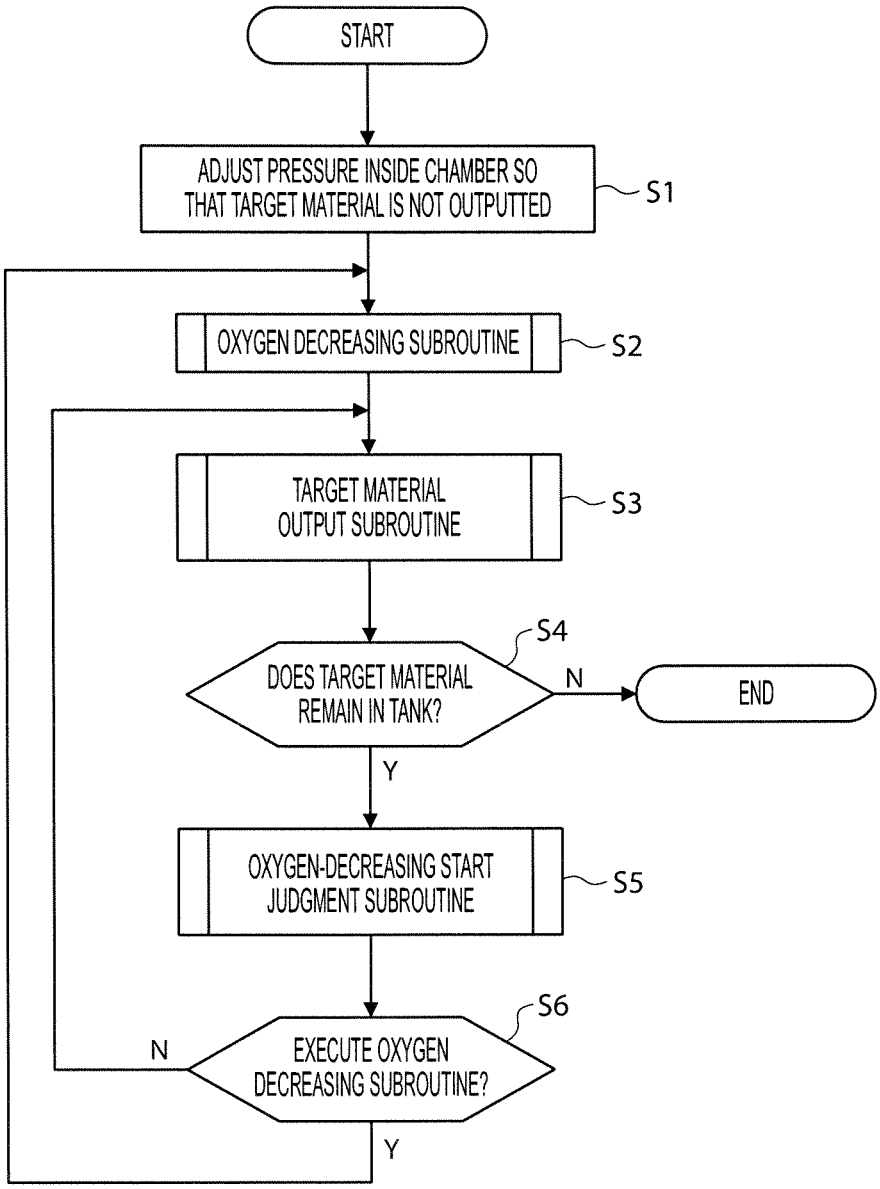
FIG. 12 is a flowchart illustrating an EUV light generation process according to a target control device.
Figure 13A:
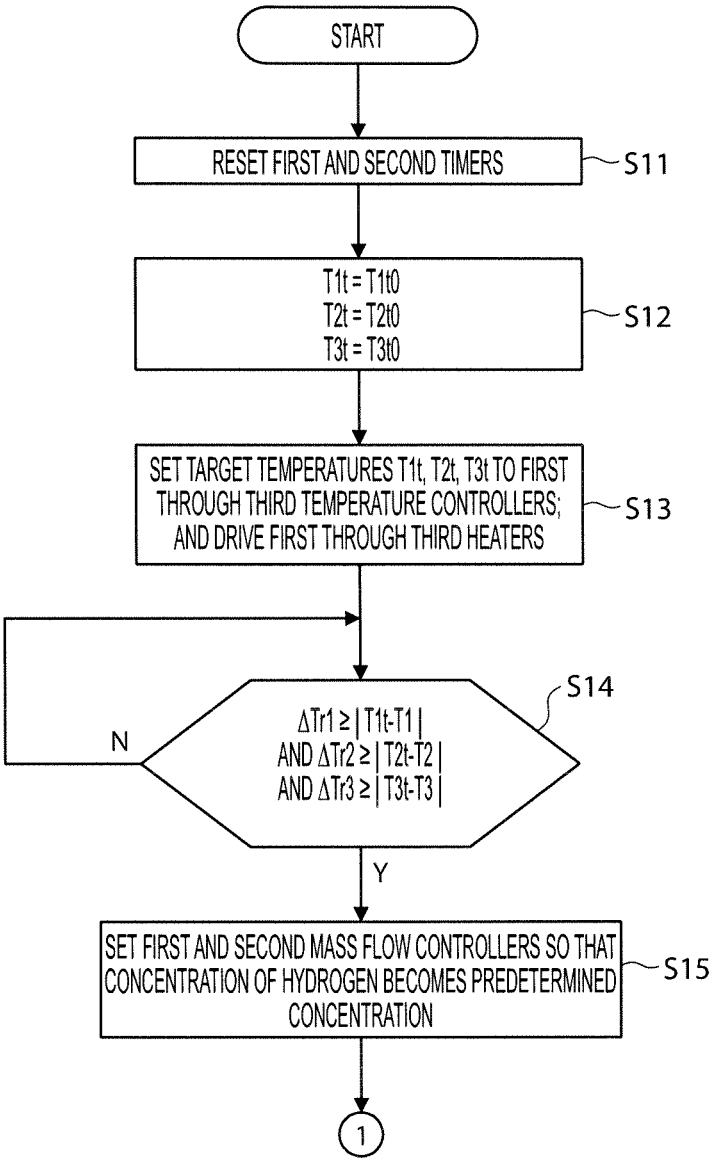
FIG. 13A is a flowchart illustrating an oxygen decreasing subroutine.
Figure 13B:
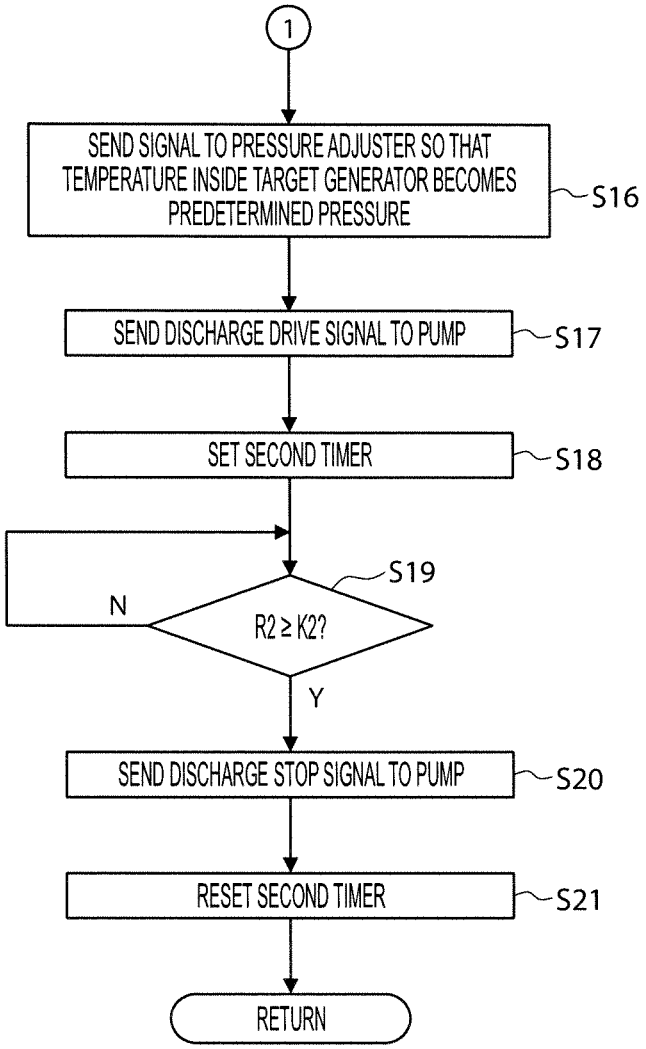
FIG. 13B is a flowchart illustrating the oxygen decreasing subroutine.
Figure 14:
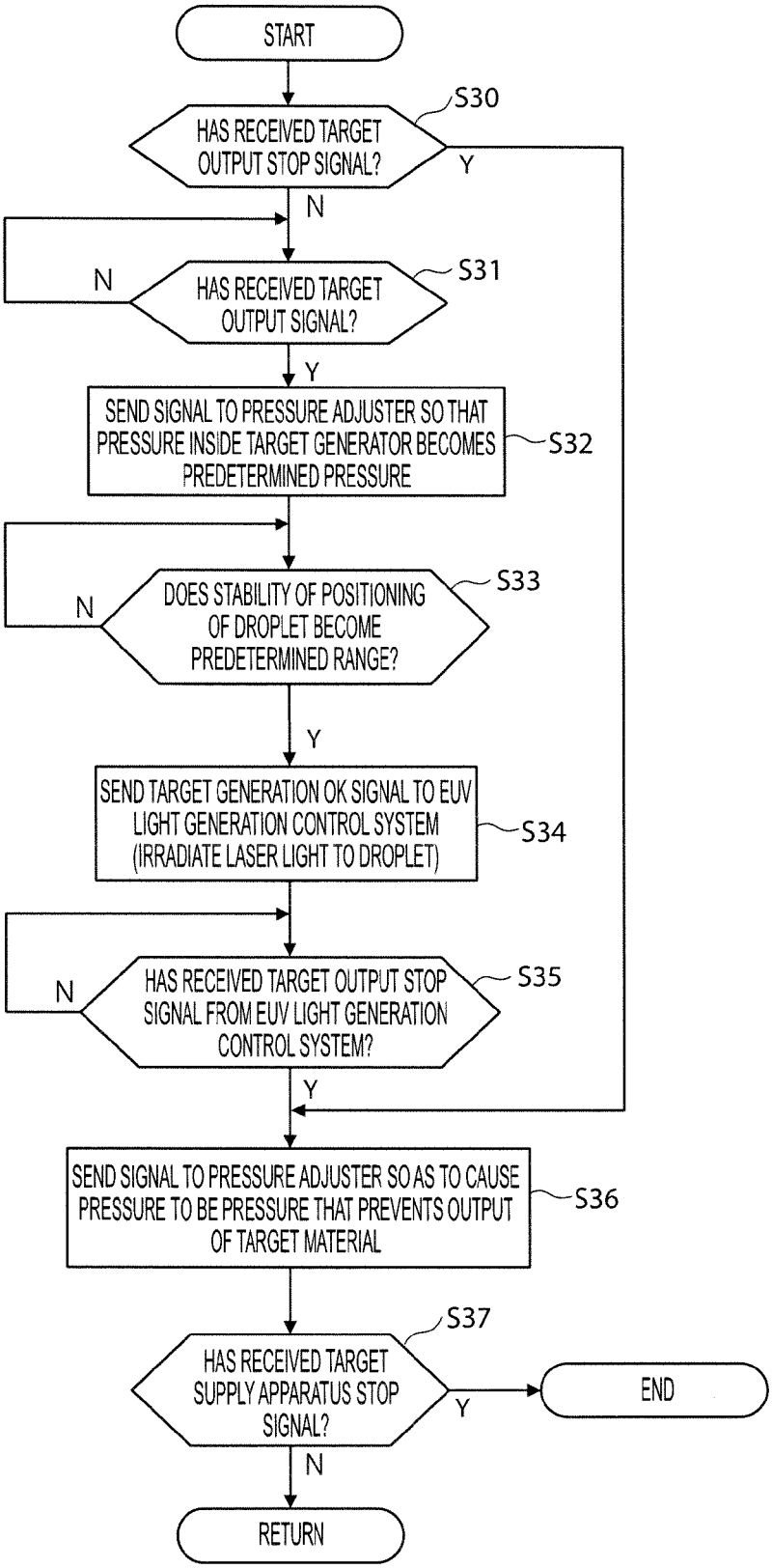
FIG. 14 is a flowchart illustrating a target material output subroutine.
Figure 15A:
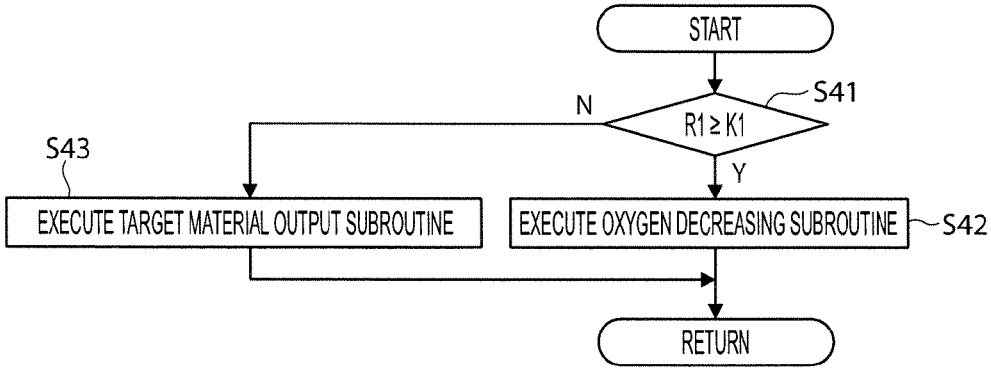
FIG. 15A is a flowchart illustrating an oxygen-decreasing start judgment subroutine.
Figure 15B:
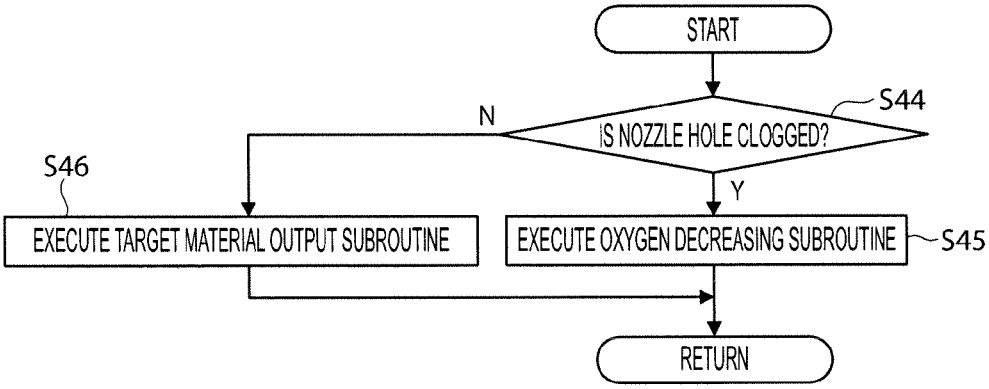
FIG. 15B is a flowchart illustrating an oxygen-decreasing start judgment subroutine.
Figure 15C:
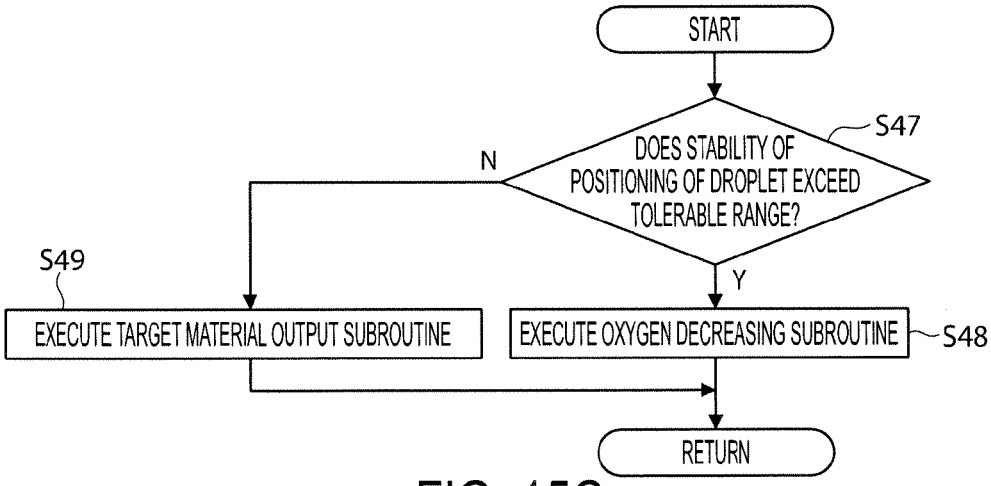
FIG. 15C is a flowchart illustrating an oxygen-decreasing start judgment subroutine.

FIG. 12 is a flowchart illustrating an EUV light generation process according to the target control device 80J. FIGS. 13A and 13B are a flowchart illustrating an oxygen decreasing subroutine. FIG. 14 is a flowchart illustrating a target material output subroutine. FIGS. 15A, 15B and 15C are flowcharts illustrating oxygen-decreasing start judgment subroutines.

The target control device 80J may execute the process shown in FIG. 12 in a state in which the solid target material 270 is accommodated in the refinement tank 91C and the sealed space 919C is formed by the lid 912C being attached onto the main tank body 911C. First, the pressure inside the chamber 2 may be adjusted so that the target material 270 will not be outputted due to difference in pressure when the target material 270 is melted (step S1).

Next, the target control device 80J may execute processing according to the oxygen decreasing subroutine (step S2). By the processing of step S2, oxygen atoms within the target material 270 accommodated in the target material refinement device 9J may be decreased.

To be more specific, the target control device 80J may, as shown in FIG. 13A, reset the first timer 81J and the second timer 82J (step S11). Next, target temperatures T1*t*, T2*t* and T3*t* of the first through third heaters 751J, 755J and 921J may be set to temperatures T1*t*0, T2*t*0 and T3*t*0, respectively (step S12). The temperatures T1*t*0, T2*t*0 and T3*t*0 may be held in a memory (not shown) or the like, and may be read out any time as needed. Among the temperatures T1*t*0, T2*t*0 and T3*t*0, the temperature T1*t*0 may be the highest while the temperature T3*t*0 may be the lowest. The temperatures T1*t*0, T2*t*0 and T3*t*0 may be equal to or higher than a melting point Tm of the target material 270. Differences in temperature among the temperatures T1*t*0, T2*t*0 and T3*t*0 may be, for example, around 10° C. For example, the temperatures T1*t*0, T2*t*0 and T3*t*0 may be approximately 370° C., 360° C. and 350° C., respectively.

Next, the target control device 80J may set the respective target temperatures T1*t*, T2*t* and T3*t* to the first through third temperature controllers 754J, 758J and 924J, and may drive the first through third heaters 751J, 755J and 921J (step S13).

Through the processing in step S13, the first through third heaters 751J, 755J and 921J may heat the target material 270 in the target generator 71J so as to apply a temperature gradient in the axial direction (setting a temperature toward the leading end of the nozzle 77J to be higher than a temperature at the other end side of the nozzle 77J). Then, the first through third temperature sensors 753J, 757J and 923J may detect the temperatures in the vicinities of the portions where the first through third heaters 751J, 755J and 921J have mainly heated the target material 270, and send signals corresponding to the detected temperatures to the first through third temperature controllers 754J, 758J and 924J, respectively. The first through third temperature controllers 754J, 758J and 924J may send the signals having been received from the first through third temperature sensors 753J, 757J and 923J to the target control device 80J.

Thereafter, the target control device 80J may determine whether or not all of the conditions indicated by the following equations (3) trough (5) are satisfied based on the signals having been received from the first through third temperature controllers 754J, 758J and 924J (step S14).

$$\Delta Tr1 \geq |T1t - T1| \quad (3)$$

$$\Delta Tr2 \geq |T2t - T2| \quad (4)$$

$$\Delta Tr3 \geq |T3t - T3| \quad (5)$$

T1: temperature detected by the first temperature sensor 753J
T2: temperature detected by the second temperature sensor 757J
T3: temperature detected by the third temperature sensor 923J
ΔTr1, ΔTr2, ΔTr3: tolerable error ranges of the temperatures obtained by controlling the corresponding heaters.

Here, each of the tolerable error ranges ΔTr1, ΔTr2 and ΔTr3 may be within a temperature range of equal to or greater than 1° C. and equal to or less than 3° C., for example. Note that the tolerable error ranges ΔTr1, ΔTr2 and ΔTr3 may be the same or may be different from each other.

In the case where the target control device 80J determines that at least one of the conditions indicated by the equations (3) through (5) is not satisfied in step S14, the processing of step S14 may be executed again after a predetermine time has elapsed. On the other hand, in the case where the target control device 80J determines that all of the conditions indicated by the equations (3) through (5) are satisfied in step S14, the first and second mass flow controllers 952C and 954C may be set so that the concentration of hydrogen in the reducing gas becomes a predetermined concentration (step S15). The predetermined concentration may be the concentration explained in the first embodiment. If it is determined in step S14 that all of the conditions described above are satisfied, the target material 270 may be melted to become liquid.

Next, the target control device 80J may, as shown in FIG. 13B, send a signal to the pressure adjuster 72 so that the pressure inside the target generator 71J becomes a predetermined pressure (step S16). Then, the target control device 80J may send a discharge drive signal to the pump 96C (step S17). It is advisable that the above predetermined pressure be determined in advance by experiment or the like.

By the processings of steps S16 and S17 described above, the reducing gas in which the concentration of water and oxygen is decreased by the purifier 955C, may be introduced into the refinement tank 91J via the bubbling mechanism 956C. The introduced reducing gas may generate the bubbles 90C and in turn the oxygen atoms in the target material 270 may be discharged into the gas space 918C in the form of water vapor. The pump 96C may evacuate the gas space 918C so as to discharge the water vapor. Through the process described above, the oxygen atoms in the target material 270 may be decreased.

After this, the target control device 80J may set the second timer 82J and start to measure a measurement-time R2 (step S18). Thereafter, it may be determined whether or not the measurement-time R2 of the second timer 82J has reached or passed a set time K2 (step S19). The set time K2 may be held in a memory (not shown) or the like and read out at any time as needed. The set time K2 may be set to a time period during which a desired amount of oxygen atoms within the target material 270 may be discharged as water vapor.

If the target control device 80J determines that the measurement-time R2 has not reached the set time K2 in step S19, the processing of step S19 may be executed again; if the target control device 80J determines that the measurement-time R2 has reached or passed the set time K2, a discharge stop signal may be sent to the pump 96C (step S20) and the second timer 82J may be reset (step S21).

Through the process described above, during the set time K2, processing for decreasing the oxygen atoms using the reducing gas is carried out so that the oxygen atoms in the target material 270 accommodated in the refinement tank 91J may be decreased.

Subsequently, the target control device 80J may, as shown in FIG. 12, execute processing according to the target material output subroutine (step S3). By the processing of step S3, the target control device 80J may generate EUV light using the target material 270 in which oxygen atoms contained therein have been decreased in step S2.

Specifically, as shown in FIG. 14, the target control device 80J may determine whether or not it has received a target output stop signal from the EUV light generation control system 5 (step S30). If the target control device 80J determines that the target output stop signal has not been received in step S30, it may proceed to processing of step S31. On the other hand, if the target control device 80J determines that the target output stop signal has been received in step S30, it may proceed to processing of step S36. The target control device 80J may determine whether or not it has received a target output signal from the EUV light generation control system 5 (step S31). In the case where the target control device 80J determines that it has not received the target output signal in step S31, the processing of step S31 may be executed again after a predetermined time has elapsed. On the other hand, if it is determined in step S31 that the target output signal has been received, the target control device 80J may send a signal to the pressure adjuster 72 so that the pressure inside of the target generator 71J becomes a predetermined pressure (step S32). At this time, the pressure inside of the chamber 2 may be simultaneously adjusted so that EUV light can be generated when the target material 270 is outputted thereinto.

The pressure adjuster 72, upon receiving the above-mentioned signal, may adjust the pressure inside of the target generator 71J (interior of the refinement tank 91J and the nozzle 77J) to a pressure so that the target material 270 may be outputted as a droplet 271. At this time, the first mass flow controller 952C may be set to zero so as to pressurize the gas space 918C only with argon gas.

Information indicating the position, velocity, size, travel direction, timing of passing a predetermined position, passage cycle, the stability of those items, and so on of the outputted droplet 271 may be detected by the target sensor 4 (see FIG. 2). These detected pieces of information may be received by the target control device 80J as respective signals.

Then, the target control device 80J may determine whether or not the stability of positioning of the droplet 271 becomes a predetermined range, in other words, whether or not a position of the outputted droplet 271 is within the predetermined range (step S33). If the target control device 80J determines in step S33 that the stability of the droplet positioning does not become the predetermined range, the processing of step S33 may be executed again. Meanwhile, if the target control device 80J determines in step S33 that the stability of the droplet positioning becomes the predetermined range, it may send a target generation OK signal to the EUV light generation control system 5 (step S34).

The EUV light generation control system 5 may be configured so that, upon receiving the target generation OK signal, the EUV light generation control system 5 inputs a pulsed laser beam oscillation trigger to the laser apparatus 3 (see FIG. 2) so that the droplet 271 is irradiated with a pulsed laser beam when the droplet 271 reaches the plasma generation region 25 (see FIG. 2).

The pulsed laser beam outputted from the laser apparatus 3 may be irradiated to the droplet 271. When the pulsed laser beam is irradiated to the droplet 271, the droplet 271 may be turned into plasma, and an electromagnetic wave including EUV light may be radiated therefrom.

Then, in the case where the generation of EUV light is to be ended, the EUV light generation control system 5 may stop the output of the pulsed laser beam by the laser apparatus 3 and may send the target output stop signal to the target control device 80J.

The target control device 80J may determine whether or not it has received the target output stop signal from the EUV light generation control system 5 (step S35). If it is determined that the signal has not been received in step S35, the target control device 80J may execute again the processing of step S35 after a predetermined time has elapsed. On the other hand, if it is determined that the signal has been received in step S35, the target control device 80J may send a signal to the pressure adjuster 72 so as to cause the pressure inside of the target generator 71J to be a pressure that prevents the droplet 271 from being outputted (step S36). Through this, the pressure adjuster 72 may adjust the pressure inside of the target generator 71J so that the droplet 271 may not be outputted from the target generator 71J.

Thereafter, the target control device 80J may determine whether or not it has received a target supply apparatus stop signal from the EUV light generation control system 5 (step S37). If it is determined in step S37 that the signal has not been received, the target control device 80J may end the processing according to the target material output subroutine and proceed to step S4 of FIG. 12. On the other hand, if it is determined in step S37 that the signal has been received, the generation of EUV light may be ended. In the case where the generation of EUV light is ended, the pressure inside of the target generator 71J may be adjusted nearly to the atmospheric pressure and the supply of electric power to the heaters may be ended.

After this, the target control device 80J may, as shown in FIG. 12, determine whether or not the target material 270 remains within the target generator 71J (step S4). Whether or not the target material 270 remains may be determined based on the time when the droplet 271 has been outputted, for example. If the target control device 80J determines in step S4 that the target material 270 does not remain, the generation of EUV light may be ended. On the other hand, if it is determined that the target material 270 remains, the target control device 80J may execute processing according to the oxygen-decreasing start judgment subroutine (step S5). By the processing of step S5, processing to be executed next may be determined.

To be more specific, the target control device 80J may execute at least one of processes shown in FIGS. 15A, 15B and 15C as the processing of step S5.

In the process shown in FIG. 15A, the target control device 80J may determine whether or not a measurement-time R1 by the first timer 81J has reached or passed a set time K1 (step S41). The start of measurement of the measurement-time R1 may be at the same timing as the start of the processing of step S2 according to the oxygen decreasing subroutine, for example.

If it is determined in step S41 that the measurement-time R1 has reached or passed the set time K1, the target control device 80J may determine to execute next the oxygen decreasing subroutine (step S42). On the other hand, if it is determined that the measurement-time R1 has not reached the set time K1, the target control device 80J may determine to execute next the target material output subroutine (step S43).

That is to say, the target control device 80J may execute the oxygen decreasing subroutine at a cycle of the set time K1.

In the process shown in FIG. 15B, the target control device 80J may determine whether or not the nozzle hole 776J is clogged (step S44). Whether or not the nozzle hole 776J is clogged may be determined according to the output from the target sensor 4. That is, if the droplet 271 is not detected by the target sensor 4 during the execution of step S34 of the target material output subroutine, the target control device 80J may determine that the nozzle hole 776J is clogged. Meanwhile, if the droplet 271 is detected during the execution of step S34 of the target material output subroutine, the target control device 80J may determine that the nozzle hole 776J is not clogged.

If it is determined in step S44 that the nozzle hole 776J is clogged, the target control device 80J may determine to execute next the oxygen decreasing subroutine (step S45); if it is determined that the nozzle hole 776J is not clogged, the target control device 80J may determine to execute next the target material output subroutine (step S46).

Further, in the process shown in FIG. 15C, the target control device 80J may determine whether or not the stability of positioning of the droplet 271 exceeds a tolerable range (step S47). The stability of positioning of the droplet 271 may be detected by the target sensor 4 during the execution of step S34 of the target material output subroutine.

If it is determined in step S47 that the stability of positioning of the droplet 271 exceeds the tolerable range, the target control device 80J may determine to execute next the oxygen decreasing subroutine (step S48); if it is determined that the stability of positioning of the droplet 271 does not exceed the tolerable range, the target control device 80J may determine to execute next the target material output subroutine (step S49).

Then, the target control device 80J may, as shown in FIG. 12, determine whether or not to execute the oxygen decreasing subroutine based on a judgment result in step S5 (step S6). In step S6, if it is determined to execute the oxygen decreasing subroutine, the target control device 80J may execute the processing of step S2; if it is determined to execute the target material output subroutine, the target control device 80J may execute the processing of step S3.

As described above, the target supply apparatus 7J may include the target material refinement device 9J to remove oxygen atoms contained in the target material 270 and the nozzle 77J to output the droplet 271 using the target material 270 in which the oxygen atoms are decreased.

With this, even if a large amount of oxygen atoms are contained in a solid target material accommodated in the target material refinement device 9J, the target supply apparatus 7J can suppress the separation of oxidants of the target material 270 and in turn may prevent the nozzle hole 776J from being clogged with the oxidants. In addition, the target supply apparatus 7J may suppress change in the output direction of the droplet 271, which is likely to occur when oxidants accumulate in the nozzle hole 776J. Moreover, even if oxygen atoms are present in the refinement tank 91J, the target supply apparatus 7J can decrease those oxygen atoms so as to suppress the separation of the oxidants.

Note that the target supply apparatus 7J may execute the oxygen decreasing subroutine at a cycle of the set time K1.

As described above, the target supply apparatus 7J may appropriately prevent oxidants from accumulating in the nozzle hole 776J by periodically executing the processing for decreasing the oxygen atoms contained in the target material 270.

Further, if the target supply apparatus 7J determines that the nozzle hole 776J is clogged, the oxygen decreasing subroutine may be executed. Furthermore, if the target supply apparatus 7J determines that the stability of positioning of the droplet 271 exceeds a tolerable range, the oxygen decreasing subroutine may be executed.

In the case where the target supply apparatus 7J is configured so that the processing for decreasing oxygen atoms is periodically executed, the target supply apparatus 7J may execute the processing for decreasing oxygen atoms even when the target material 270 is being appropriately outputted and the execution of the processing is not needed.

By executing the processing for decreasing oxygen atoms in the target material 270 in accordance with the state of output of the target material 270, the target supply apparatus 7J may execute the processing for decreasing the oxygen atoms only at a timing when the execution is needed.

Moreover, the target supply apparatus 7J may apply a temperature gradient in the axis direction to the target material 270.

With such temperature control, it is possible to make the dissolving amount of oxygen atoms at the nozzle hole 776J side larger than that at the upper end side in the target generator 71J, thereby making it possible to prevent oxidants from accumulating in the nozzle hole 776J.

Note that the target material refinement device 9J is not limited to a device similar to the target mater refinement device 9C of the first embodiment, and a device similar to any of the target material refinement devices 9D, 9E, 9F, 9G and 9H of the second, third, fourth, fifth and sixth embodiments, respectively may be employed.

6.2 Eighth Embodiment

6.2.1 Outline

According to an eighth embodiment of the present disclosure, a target supply apparatus included in an EUV light generation apparatus may have a target material refinement device for decreasing oxygen atoms in a target material, a target generator, a generator heating section, a transfer section, and a target supply controller. The generator heating section may heat the target generator. The transfer section may transfer the target material in which the oxygen atoms contained therein are decreased by the target material refinement device to the target generator. The target supply controller may cause the temperature of the target material in the target generator to be higher than that of the target material in a refinement tank configuring the target material refinement device.

With the above configuration, the target supply apparatus of the eighth embodiment may provide the same effect as in the seventh embodiment.

Note that in the target material refinement device, oxygen atoms may be removed as oxidants with such a simple configuration in which the melting temperature of the target material is controlled. In particular, in the refinement tank, by heating the target material at a lower temperature, a larger amount of oxygen atoms may be removed in comparison with a case of heating the target material at a higher temperature. Further, in the target generator, a larger amount of oxygen atoms may be dissolved in the target material by heating the target material at a higher temperature in comparison with a case of heating the target material at a lower temperature. This may suppress the separation of oxidants of the target material used for the generation of EUV light.

6.2.2 Configuration

Figure 16:
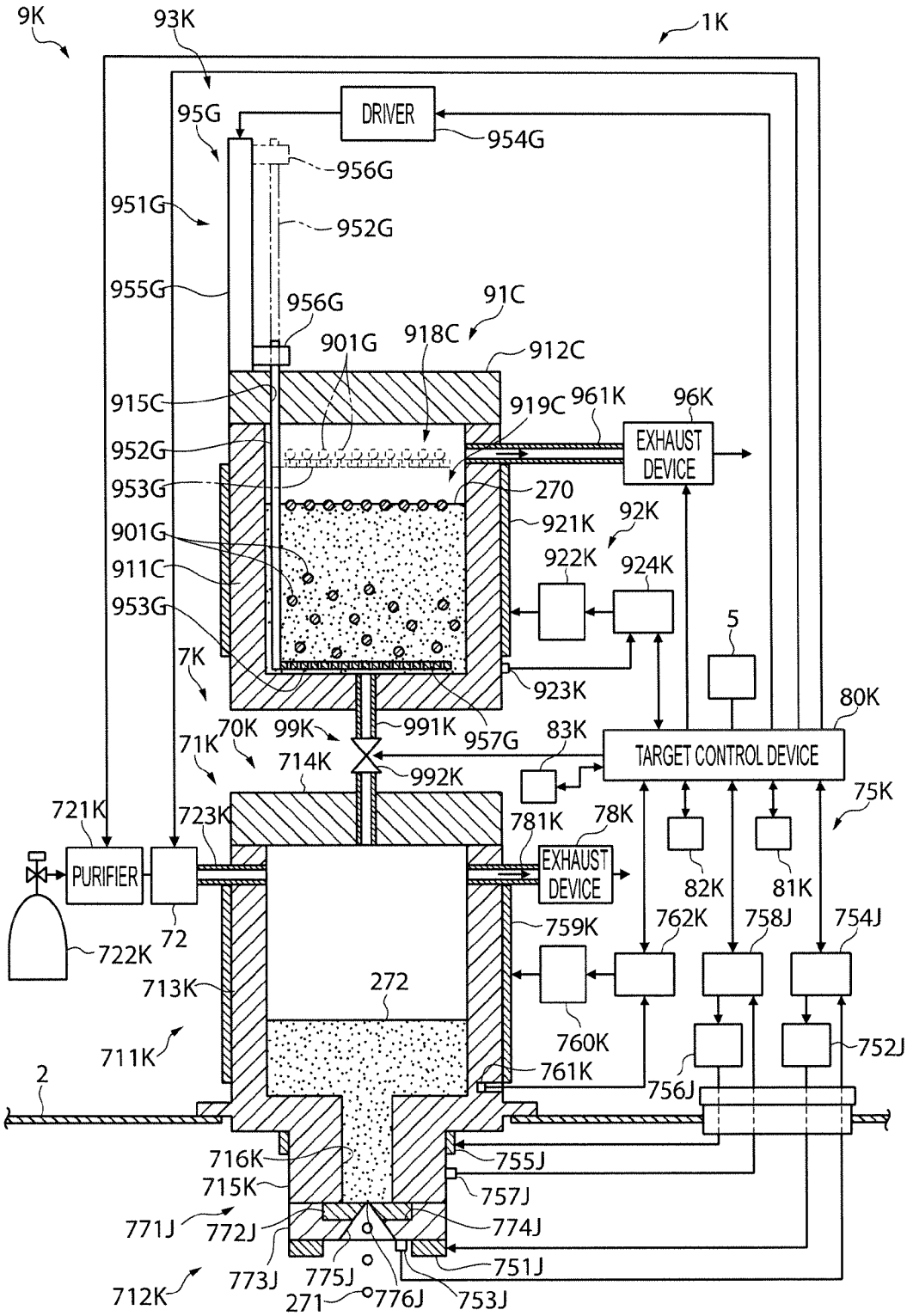
FIG. 16 is a schematic view illustrating the configuration of an EUV light generation apparatus including a target material refinement device according to an eighth embodiment.

FIG. 16 schematically illustrates the configuration of an EUV light generation apparatus including a target material refinement device according to the eighth embodiment.

An EUV light generation apparatus 1K of the eighth embodiment may include a target material refinement device 9K similar to the target material refinement device 9G of the fifth embodiment, and a target generator 71K similar to the target generator 71J of the seventh embodiment. The EUV light generation apparatus 1K may generate EUV light using the target material 270 produced in the target material refinement device 9K.

As shown in FIG. 16, the EUV light generation apparatus 1K may include the chamber 2, the EUV light generation control system 5, a target supply apparatus 7K, the target material refinement device 9K, and a transfer section 99K.

The target supply apparatus 7K may include a target generation section 70K and a target control device 80K as the target supply controller.

The target generation section 70K may include the target generator 71K, the pressure adjuster 72, a temperature adjustment section 75K as the generator heating section, and a first exhaust device 78K. The first exhaust device 78K may be a pump. Although not illustrated nor explained here, the target generation section 70K may be equipped with the piezoelectric driver 74A as shown in FIG. 2.

The target generator 71K may include a tank 711K. The tank 711K may include a main tank body 713K and a lid 714K. The main tank body 713K may be cylindrical. The lid 714K may be approximately plate-shaped so as to cover the upper face of the main tank body 713K. A target material 272 may be accommodated in the tank 711K.

A nozzle 712K to output the target material 272 within the main tank body 713K into the chamber 2, may be provided in the tank 711K. The nozzle 712K may include a main nozzle body 715K extending downward from the center of the bottom of the main tank body 713K, and the nozzle tip portion 771J attached to the tip of the main nozzle body 715K.

The main nozzle body 715K may be formed in a cylinder shape. A hollow portion of the main nozzle body 715K may configure a communication portion 716K for introducing the target material 272 in the main tank body 713K to the nozzle tip portion 771J.

The nozzle tip portion 771J may have the same configuration as in the seventh embodiment.

The pressure adjuster 72 may be connected to an argon gas tank 722K via a purifier 721K. The pressure adjuster 72 may be connected to the upper end side of the tank 711K through a pipe 723K. The pressure adjuster 72 may be electrically connected to the target control device 80K. The purifier 721K may supply an argon gas in which the concentration of water and oxygen is decreased to the pressure adjuster 72. The pressure adjuster 72 may adjust the pressure of the argon gas supplied from the purifier 721K and introduce this argon gas into the target generator 71K.

The temperature adjustment section 75K may include: the first heater 751J, the second heater 755J and a third heater 759K; the first heater power source 752J, the second heater power source 756J and a third heater power source 760K; the first temperature sensor 753J, the second temperature sensor 757J and a third temperature sensor 761K; and the first temperature controller 754J, the second temperature controller 758J and a third temperature controller 762K.

The third heater 759K may be provided on the outer circumferential surface of the tank 711K.

The third heater power source 760K may be electrically connected to the third heater 759K and the third temperature controller 762K, and may supply electric power to the third heater 759K based on a signal from the third temperature controller 762K.

The third temperature sensor 716K may be provided at a position which is on the outer circumferential surface of the tank 711K and is on the lower side of the third heater 759K. The third temperature sensor 761K may detect the temperature of the tank 711K and send a signal corresponding to the detected temperature to the third temperature controller 762K.

The third temperature controller 762K may be electrically connected to the target control device 80K. The third temperature controller 762K may be so configured as to determine a temperature of the target material 272 in the tank 711K based on the signal from the third temperature sensor 761K, and output to the third heater power source 760K a signal for adjusting the temperature of the target material 272 to a predetermined temperature.

The first exhaust device 78K may be connected to the upper end side of the tank 711K via a pipe 781K. The first exhaust device 78K may be electrically connected to the target control device 80K. The first exhaust device 78K may evacuate the interior of the tank 711K based on a signal sent from the target control device 80K.

A first timer 81K, a second timer 82K and a third timer 83K may be electrically connected to the target control device 80K.

The target material refinement device 9K may include the refinement tank 91C, an oxygen-atom removing section 93K, and a second exhaust device 96K as the oxygen partial-pressure adjusting section and the exhaust section.

The oxygen-atom removing section 93K may include a heating section 92K as the separating section and the oxidant removing section 95G.

The heating section 92K may include a fourth heater 921K, a fourth heater power source 922K, a fourth temperature sensor 923K, and a fourth temperature controller 924K.

The fourth heater 912K may be provided on the outer circumferential surface of the main tank body 911C.

The fourth heater power source 922K may be electrically connected to the fourth heater 921K and the fourth temperature controller 924K, and may supply electric power to the fourth heater 921K based on a signal from the fourth temperature controller 924K.

The fourth temperature sensor 923K may be provided at a position which is on the outer circumferential surface of the main tank body 911C and is on the lower side of the fourth heater 921K. The fourth temperature sensor 923K may detect the temperature of the main tank body 911C and send a signal corresponding to the detected temperature to the fourth temperature controller 924K.

The fourth temperature controller 924K may be electrically connected to the target control device 80K. The fourth temperature controller 924K may be so configured as to determine a temperature of the target material 270 in the main tank body 911C based on the signal from the fourth temperature sensor 923K, and output to the fourth heater power source 922K a signal for adjusting the temperature of the target material 270 to a predetermined temperature.

The driver 954G of the oxidant removing section 95G may be electrically connected to the target control device 80K.

The second exhaust device 96K may be a turbo-molecular pump. The second exhaust device 96K may be equipped with an appropriate backing pump. The second exhaust device 96K may be connected to the upper end side of the main tank body 911C via a pipe 961K. The second exhaust device 96K may be electrically connected to the target control device 80K. The second exhaust device 96K may evacuate the interior of the refinement tank 91C to be at a low pressure close to a vacuum state.

The transfer section 99K may be equipped with a transfer pipe 991K.

The transfer pipe 991K may be formed in a pipe shape. The transfer pipe 991K may be connected to the bottom of the refinement tank 91C and to the upper face of the tank 711K so as to transfer the target material 270 from the interior of the refinement tank 91C into the tank 711K.

Further, the transfer pipe 991K may be provided with a valve 992K.

The valve 992K may be electrically connected to the target control device 80K. The valve 992K may be configured so that two states, that is, an open state in which the target material 270 in the refinement tank 91C can be transferred into the tank 711K and a close state in which the target material 270 is not transferred, can be switched to each other under control of the target control device 80K.

6.2.3 Operation

Figure 17:
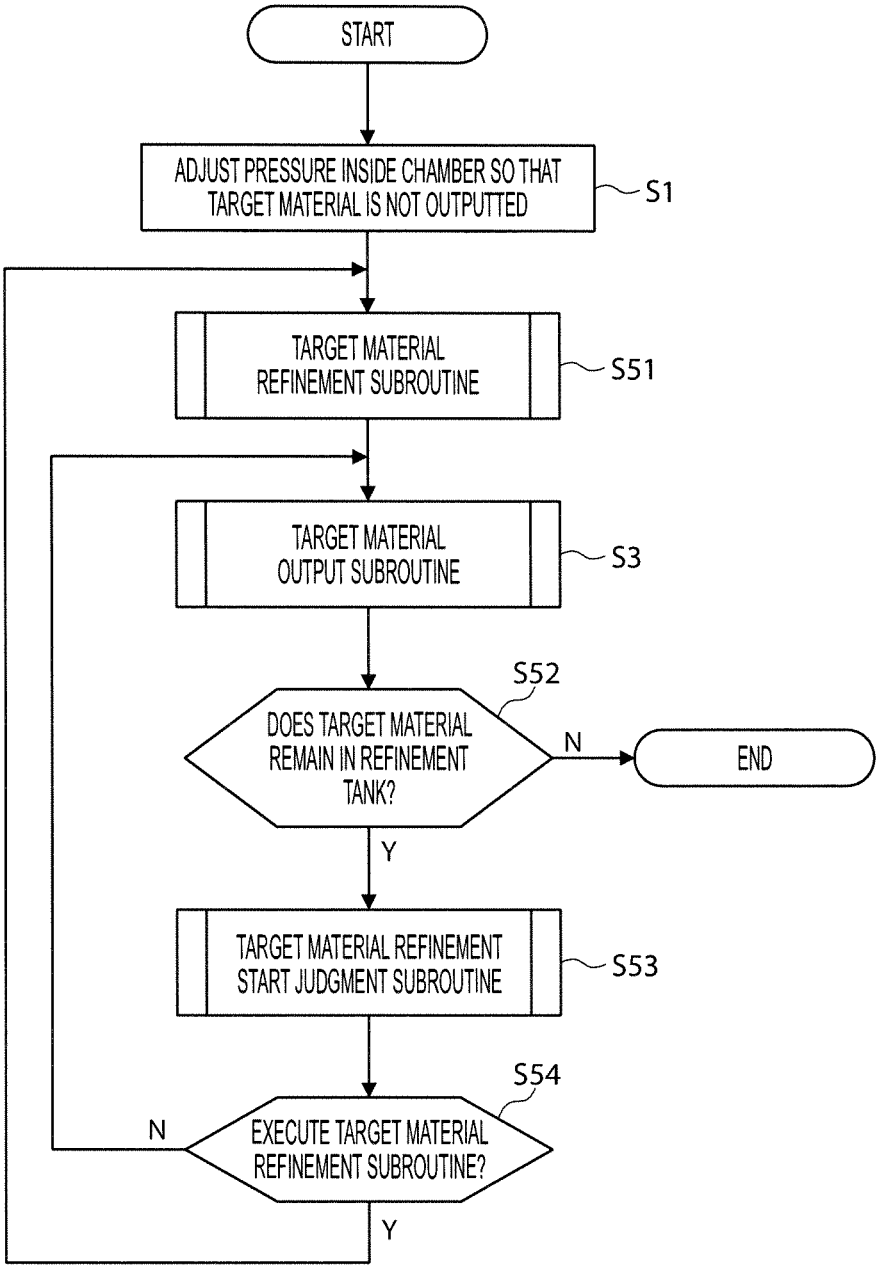
FIG. 17 is a flowchart illustrating an EUV light generation process according to the target control device.
Figure 18A:
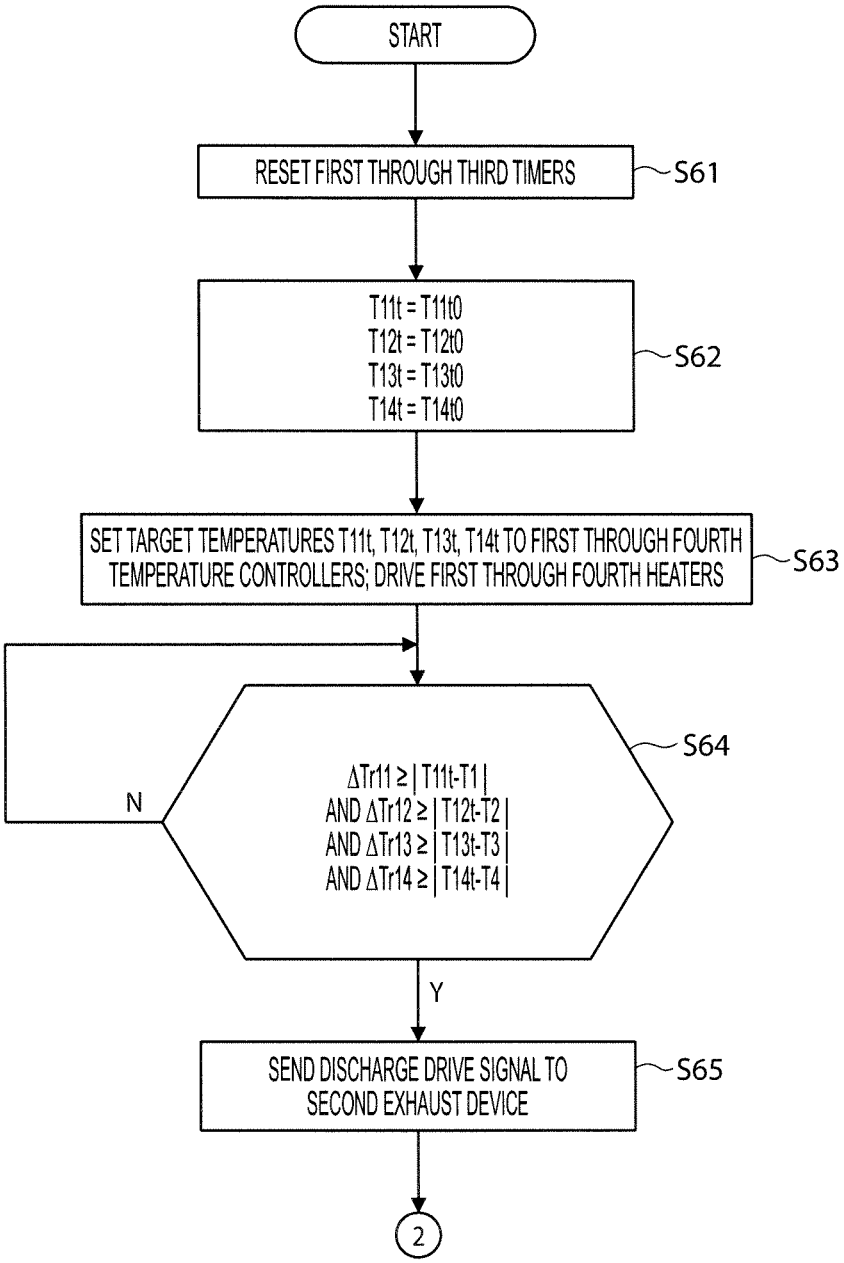
FIG. 18A is a flowchart illustrating a target material refinement subroutine.
Figure 18B:
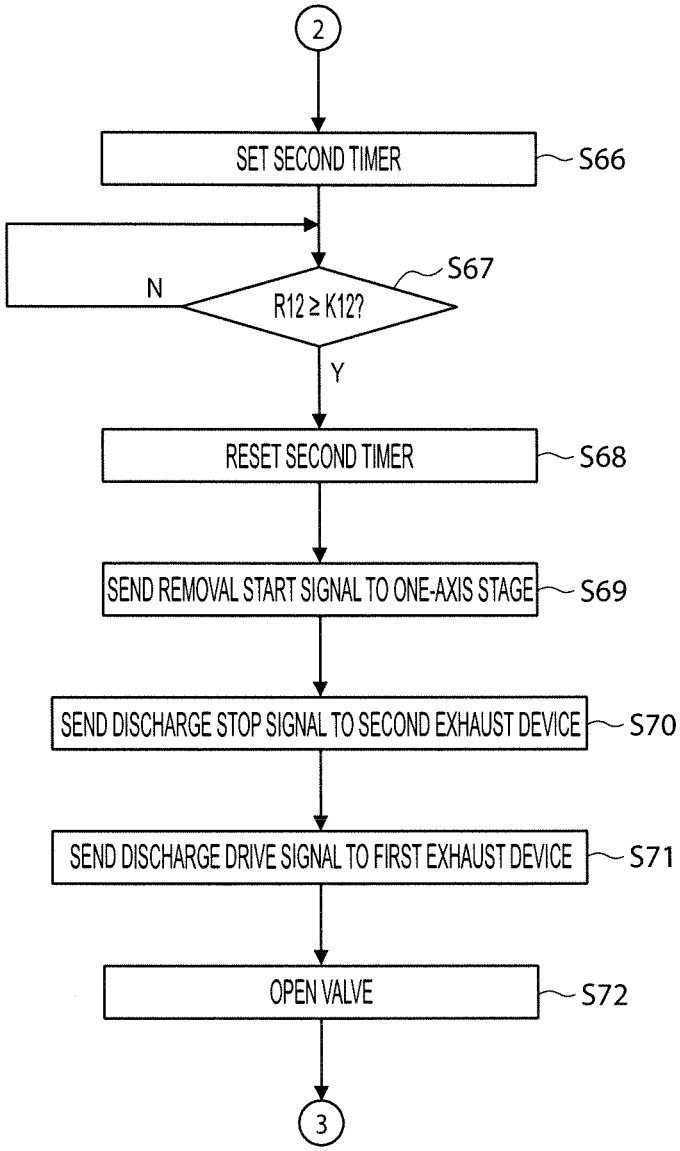
FIG. 18B is a flowchart illustrating the target material refinement subroutine.
Figure 18C:
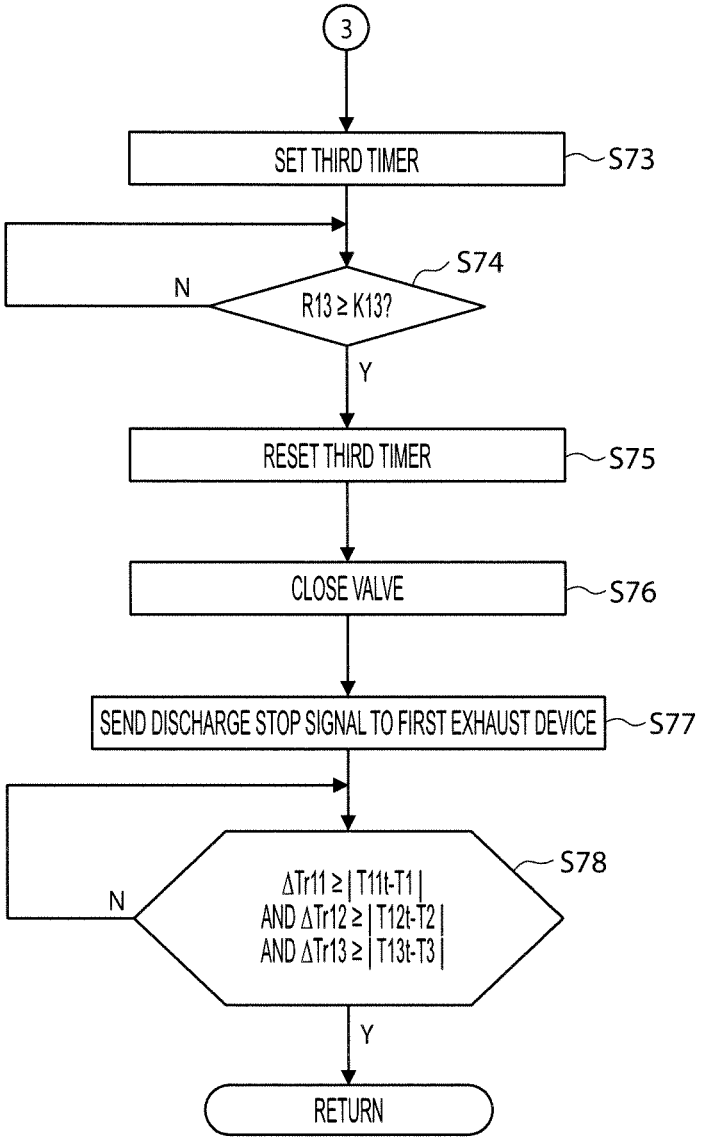
FIG. 18C is a flowchart illustrating the target material refinement subroutine.
Figure 19A:
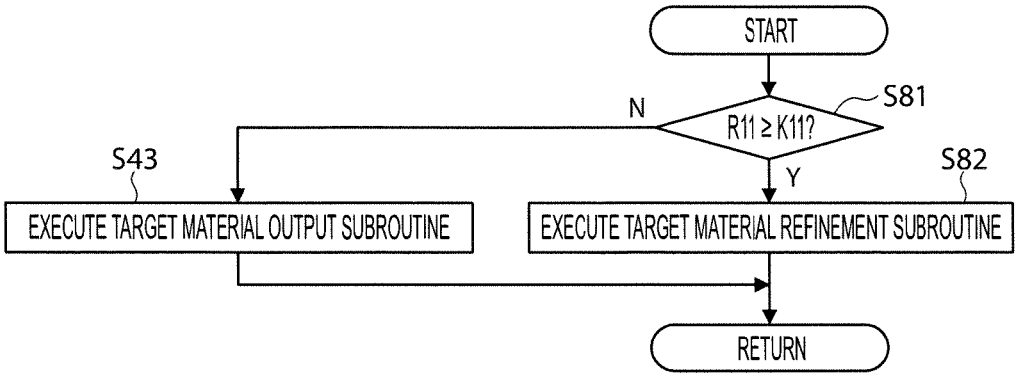
FIG. 19A is a flowchart illustrating a target material refinement start judgment subroutine.
Figure 19B:
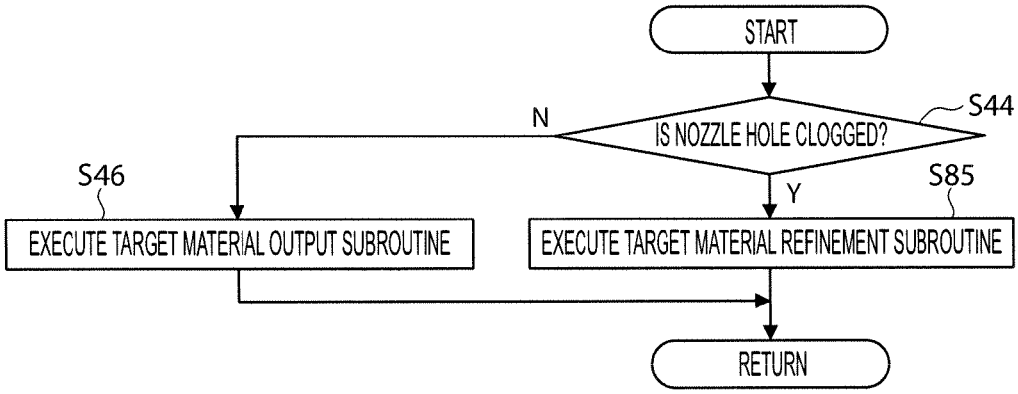
FIG. 19B is a flowchart illustrating a target material refinement start judgment subroutine.
Figure 19C:
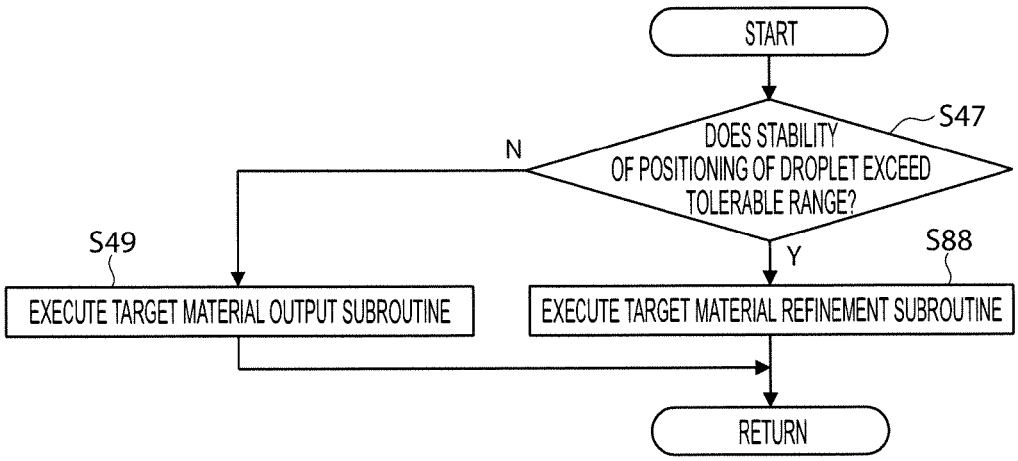
FIG. 19C is a flowchart illustrating a target material refinement start judgment subroutine.

FIG. 17 is a flowchart illustrating an EUV light generation process according to the target control device 80K. FIGS. 18A, 18B and 18C are a flowchart illustrating a target material refinement subroutine. FIGS. 19A, 19B and 19C are flowcharts illustrating target material refinement start judgment subroutines.

It is to be noted that as a target material output subroutine in the eighth embodiment, the same process as of the target material output subroutine of the seventh embodiment illustrated in FIG. 14, may be carried out.

As shown in FIG. 17, the target control device 80K may execute processing of step S1 in a state in which the mesh filter 953G is positioned near the bottom of the sealed space 919C and the solid target material 270 is accommodated in the sealed space 919C. Before executing the processing of step S1, it does not matter whether the solid target material 272 is accommodated in the target generator 71K or not. Further, before executing the processing of step S1, the valve 992K may be in a close sate.

Thereafter, the target control device 80K may execute processing according to the target material refinement subroutine (step S51). By the processing of step S51, oxygen atoms within the target material 270 that is accommodated in the target material refinement device 9K may be decreased.

To be more specific, the target control device 80K may, as shown in FIG. 18A, reset the first timer 81K, the second timer 82K and the third timer 83K (step S61), and set target temperatures T11*t*, T12*t*, T13*t* and T14*t* of the first through fourth heaters 751J, 755J, 759K and 921K to temperatures T11*t*0, T12*t*0, T13*t*0 and T14*t*0, respectively (step S62). The temperatures T11*t*0, T12*t*0, T13*t*0 and T14*t*0 may be held in a memory (not shown) or the like, and may be read out any time as needed. Among the temperatures T11*t*0 through T14*t*0, the temperature T11*t*0 may be the highest while the temperature T14*t*0 may be the lowest. The temperatures T11*t*0 through T14*t*0 may be equal to or higher than a melting point Tm of the target material 270 and target material 272. Differences in temperature among the temperatures T11*t*0, T12*t*0 and T13*t*0 may be, for example, around 10° C. For example, the temperatures T11*t*0, T12*t*0 and T13*t*0 may be approximately 370° C., 360° C. and 350° C., respectively. Further, the temperature T14*t*0 may be approximately 232° C. (melting point Tm of the target material 270 and target material 272), for example.

Next, the target control device 80K may set the respective target temperatures T11*t* through T14*t* to the first through fourth temperature controllers 754J, 758J, 762K and 924K, and drive the first through fourth heaters 751J, 755J, 759K and 921K (step S63).

Through the processing of step S63, the first through third heaters 751J, 755J and 759K may heat the target generator 71K so as to apply a temperature gradient in the axial direction (setting a temperature toward the leading end of the nozzle 712K to be higher than a temperature at the other end side of the nozzle 712K). Then, the first through third temperature sensors 753J, 757J and 761K may detect the temperatures in the vicinities of the portions that the first through third heaters 751J, 755J and 759K have mainly heated, and send signals corresponding to the detected temperatures to the first through third temperature controllers 754J, 758J and 762K, respectively. The first through third temperature controllers 754J, 758J and 762K may send the signals having been received from the first through third temperature sensors 753J, 757J and 761K to the target control device 80K.

The fourth heater 921K may heat the target material 270 in the refinement tank 91C to increase the amount of separated oxidants 901G. The fourth temperature sensor 923K may detect the temperature of the target material 270 and send a signal corresponding to the detected temperature to the fourth temperature controller 924K. The fourth temperature controller 924K may send the signal having been received from the fourth temperature sensor 923K to the target control device 80K.

Thereafter, the target control device 80K may determine whether or not all of the conditions indicated by the following equations (6) trough (9) are satisfied based on the signals having been received from the first through fourth temperature controllers 754J, 758J, 762K and 924K (step S64).

$$\Delta Tr11 \geq |T11t - T1| \quad (6)$$

$$\Delta Tr12 \geq |T12t - T2| \quad (7)$$

$$\Delta Tr13 \geq |T13t - T3| \quad (8)$$

$$\Delta Tr14 \geq |T14t - T4| \quad (9)$$

T1: temperature detected by the first temperature sensor 753J
T2: temperature detected by the second temperature sensor 757J
T3: temperature detected by the third temperature sensor 761K
T4: temperature detected by the fourth temperature sensor 923K
ΔTr11, ΔTr12, ΔTr13, ΔTr14: tolerable error ranges of the temperatures obtained by controlling the corresponding heaters.

Here, each of the tolerable error ranges ΔTr11 through ΔTr14 may be within a temperature range of equal to or greater than 1° C. and equal to or less than 3° C., for example. Note that the tolerable error ranges ΔTr11 through ΔTr14 may be the same or may be different from each other.

In the case where the target control device 80K determines that at least one of the conditions indicated by the equations (6) through (9) is not satisfied in step S64, the processing of step S64 may be executed again after a predetermine time has elapsed. On the other hand, in the case where the target control device 80K determines that all of the conditions indicated by the equations (6) through (9) are satisfied in step S64, the discharge drive signal may be sent to the second exhaust device 96K (step S65).

If it is determined in step S64 that all of the conditions described above are satisfied, the target material 270 in the refinement tank 91C may be melted to become liquid. In the case where the target material 272 is accommodated in the target generator 71K, the target material 272 may become liquid while being applied a temperature distribution in the axis direction.

Upon receiving the discharge drive signal, the second exhaust device 96K may evacuate the gas space 918C to be at a low pressure close to a vacuum state. When the gas space 918C is evacuated to be at a low pressure close to a vacuum state, the oxygen partial pressure in the gas space 918C becomes lower than that in the target material 270, whereby the oxygen atoms in the target material 270 may be discharged through the gas space 918C by the second exhaust device 96K. Through the process described above, the oxygen atoms in the target material 270 may be decreased.

Next, the target control device 80K may set the second timer 82K and start to measure a measurement-time R12 (step S66). Thereafter, it may be determined whether or not the measurement-time R12 of the second timer 82K has reached or passed a set time K12 (step S67). The set time K12 may be held in a memory (not shown) or the like and read out at any time as needed. The set time K12 may be set to a time period during which a desired amount of oxygen atoms incapable of being dissolved at the temperature T14*t* may be separated in the form of the separated oxidants 910G.

If the target control device 80K determines that the measurement-time R12 has not reached the set time K12 in step S67, the processing of step S67 may be executed again; if the target control device 80K determines that the measurement-time R12 has reached or passed the set time K12, the second timer 82K may be reset (step S68).

Through the process described above, approximately all of the oxygen atoms incapable of being dissolved at the temperature T14*t* may be separated in the form of the separated oxidants 901G.

Next, the target control device 80K may send the removal-start signal to the one-axis stage 951G via the driver 954G (step S69). With this removal-start signal, the driver 954G may lift the mesh filter 953G from the target material 270 to the gas space 918C. The separated oxidants 901G may be removed by the mesh filter 953G during the mesh filter 953G being lifted, whereby the oxygen atoms in the target material 270 may be decreased. The target control device 80K may send the discharge stop signal to the second exhaust device 96K to end the evacuation of the gas space 918C (step S70).

The target control device 80K may send the discharge drive signal to the first exhaust device 78K to evacuate the interior of the target generator 71K (step S71). The target control device 80K may open the valve 992K (step S72), and set the third timer 83K, as shown in FIG. 18C (step S73).

The target control device 80K may determine whether or not a measurement-time R13 of the third timer 83K has reached or passed a set time K13 (step S74). The set time K13 may be held in a memory (not shown) or the like and read out at any time as needed. The set time K13 may be set to a time period during which a predetermined amount of the target material 270 in the refinement tank 91C can be supplied into the target generator 71K.

If the target control device 80K determines in step S74 that the measurement-time R13 has not reached the set time K13, the processing of step S74 may be executed again; if the target control device 80K determines that the measurement-time R13 has reached or passed the set time K13, the third timer 83K may be reset (step S75).

Through the process described above, the target material 270 in which oxygen atoms contained therein are decreased, may be supplied into the target generator 71K.

The target control device 80K may close the valve 992K (step S76) and send the discharge stop signal to the first exhaust device 78K (step S77).

Then, the target control device 80K may determine whether or not all of the conditions indicated by the equations (6) through (8) are satisfied (step S78). If it is determined in step S78 that all of the above conditions are not satisfied, the target control device 80K may execute again the processing of step S78 after a predetermined time has elapsed. On the other hand, if it is determined in step S78 that all of the conditions are satisfied, the target control device 80K may end the processing according to the target material refinement subroutine.

Here, the target generator 71K is heated so that a temperature distribution in the axis direction is applied in step S64; however, because the target material 270 is supplied into the target generator 71K in steps S74 and S75, the temperature of the target generator 71K may be lowered. Then, by executing the processing of step S78, the temperature distribution in the axis direction may be applied to the target material 272 in the target generator 71K.

Thereafter, as shown in FIG. 17, the target control device may execute processing according to the target material output subroutine (step S3). The target material output subroutine may be the same as the one illustrated in FIG. 14. Through the processing of step S3, the target control device 80K may generate EUV light using the target material 272 in which oxygen atoms contained therein have been decreased in step S51.

When the execution of the processing of step S3 is over, the target control device 80K may determine whether or not the target material 270 remains in the refinement tank 91C (step S52). Whether or not the target material 270 remains may be determined based on the time when the droplet 271 has been outputted, for example. If the target control device 80K determines in step S52 that the target material 270 does not remain, the generation of EUV light may be ended. On the other hand, if it is determined that the target material 270 remains, the target control device 80K may execute processing according to the target material refinement start judgment subroutine (step S53). By the processing of step S53, processing to be executed next may be determined.

To be more specific, the target control device 80K may execute at least one of processes shown in FIGS. 19A, 19B and 19C as the processing of step S53.

In the process shown in FIG. 19A, the target control device 80K may determine whether or not a measurement-time R11 by the first timer 81K has reached or passed a set time K11 (step S81). The start of measurement of the measurement-time R11 may be at the same timing as the start of the processing of step S51 according to the target material refinement subroutine, for example.

If it is determined in step S81 that the measurement-time R11 has reached or passed the set time K11, the target control device 80K may determine to execute next the target material refinement subroutine (step S82). On the other hand, if it is determined that the measurement-time R11 has not reached the set time K11, the target control device 80K may determine to execute processing of step S43.

That is to say, the target control device 80K may execute the target material refinement subroutine at a cycle of the set time K11.

In the process shown in FIG. 19B, the target control device 80K may determine whether or not the nozzle hole 776J is clogged in process of step S44. Whether or not the nozzle hole 776J is clogged may be determined in the same manner as described in FIG. 15B. If the target control device 80K determines in step S44 that the nozzle hole 776J is clogged, it may determine to execute next the target material refinement subroutine (step S85); if it is determined that the nozzle hole 776J is not clogged, the target control device 80K may determine to execute processing of step S46.

Further, in the process shown in FIG. 19C, the target control device 80K may determine in processing of step S47 whether or not the stability of positioning of the droplet 271 exceeds a tolerable range. The stability of positioning of the droplet 271 may be detected in the same manner as described in FIG. 15C. If the target control device 80K determines in step S47 that the stability of positioning of the droplet 271 exceeds the tolerable range, it may determine to execute next the target material refinement subroutine (step S88); if it is determined that the stability of positioning of the droplet 271 does not exceed the tolerable range, the target control device 80K may determine to execute processing of step S49.

Then, the target control device 80K may, as shown in FIG. 17, determine whether or not to execute the target material refinement subroutine based on a judgment result in step S53 (step S54). In step S54, if it is determined to execute the target material refinement subroutine, the target control device 80K may execute the processing of step S51; if it is determined to execute the target material output subroutine, the target control device 80K may execute the processing of step S3.

As described above, the target supply apparatus 7K may include the target material refinement device 9K, the transfer section 99K for transferring the target material 270 in which the oxygen atoms are decreased to the target generator 71K, and the target control device 80K that makes the temperature of the target material 272 in the target generator 71K higher than that of the target material 270 in the refinement tank 91C.

With this, even if a large amount of oxygen atoms are contained in a solid target material accommodated in the target material refinement device 9K, the target supply apparatus 7K can suppress the separation of oxidants of the target material 272 and may provide the same effect as in the seventh embodiment.

In particular, in the refinement tank 91C, by heating the target material 270 at a lower temperature, a larger amount of oxygen atoms may be removed as the separated oxidants 901G in comparison with a case of heating at a higher temperature. Further, in the target generator 71K, a larger amount of oxygen atoms may be dissolved in the target material 272 by heating the target material 272 at a higher temperature in comparison with a case of heating at a lower temperature. This may suppress the separation of oxidants of the target material 272.

Note that the target supply apparatus 7K may execute the target material refinement subroutine at a cycle of the set time K11.

As described above, the target supply apparatus 7K may appropriately prevent oxidants from being separated out in the nozzle hole 776J by periodically executing the processing for decreasing oxygen atoms contained in the target material 270.

Further, if the target supply apparatus 7K determines that the nozzle hole 776J is clogged or that the stability of positioning of the droplet 271 exceeds a tolerable range, the target material refinement subroutine may be executed.

By executing the processing for decreasing oxygen atoms contained in the target material 270 in accordance with the state of output of the target material 270, the target supply apparatus 7K may execute the processing for decreasing the oxygen atoms only at a timing when the execution is needed.

Note that the target material refinement device 9K is not limited to a device similar to the target mater refinement device 9G of the fifth embodiment, and a device similar to any of the target material refinement devices 9C, 9D, 9E, 9F and 9H of the first, second, third, fourth and sixth embodiments, may be applied.

The aforementioned descriptions are intended to be taken only as examples, and are not to be seen as limiting in any way. Accordingly, it will be clear to those skilled in the art that variations on the embodiments of the present disclosure can be made without departing from the scope of the appended claims.

The terms used in the present specification and in the entirety of the scope of the appended claims are to be interpreted as not being limiting. For example, wording such as "includes" or "is included" should be interpreted as not being limited to the item that is described as being included. Furthermore, "has" should be interpreted as not being limited to the item that is described as being had. Furthermore, the modifier "a" or "an" as used in the present specification and the scope of the appended claims should be interpreted as meaning "at least one" or "one or more".

What is claimed is:

1. A target material refinement device that refines a target material used for generation of EUV light, comprising:

a refinement tank configured to accommodate a target material;

a heating section configured to heat an interior of the refinement tank; and an oxygen-atom removing section configured to remove oxygen atoms present in the target material, wherein the oxygen-atom removing section includes:

a reduction section configured to reduce the oxygen atoms; and an exhaust section to evacuate the interior of the refinement tank, and the reduction section includes a gettering substance that generates oxidants with the oxygen atoms.

2. The target material refinement device according to claim 1, wherein the oxygen-atom removing section includes:

an oxygen partial-pressure adjusting section configured to control an oxygen partial pressure inside of the refinement tank to be lower than the oxygen partial pressure in the target material; and the exhaust section configured to evacuate the interior of the refinement tank.

3. The target material refinement device according to claim 2, wherein the oxygen partial-pressure adjusting section is an oxygen-free gas supply section configured to supply an oxygen-free gas into the refinement tank.

4. The target material refinement device according to claim 2, wherein the oxygen partial-pressure adjusting section is configured with the exhaust section configured to evacuate the interior of the refinement tank to be in a vacuum state in the interior of the refinement tank.

5. The target material refinement device according to claim 1, wherein the oxygen-atom removing section includes:

an inert gas supply section configured to supply an inert gas into the target material; and the exhaust section configured to evacuate the interior of the refinement tank.

6. The target material refinement device according to claim 1, wherein the oxygen-atom removing section includes:

a separating section configured to separate oxidants formed of the oxygen atoms and other elements; and an oxidant removing section configured to remove the above oxidants.

7. The target material refinement device according to claim 6, wherein the separating section is the heating section configured to control a melting temperature of the target material and separates oxidants formed of the oxygen atoms and the target material.

8. A target supply apparatus comprising:

the target material refinement device according to claim 2; and a nozzle which has a through-hole and is disposed so that the through-hole communicates with the interior of the refinement tank of the target material refinement device.

9. A target supply apparatus comprising:

the target material refinement device according to claim 7;

a target generator configured to outputs a target material into a chamber where EUV light is generated;

a generator heating section configured to heat and melt the target material in the target generator;

a transfer section configured to transfer the target material in the refinement tank of the target material refinement device to the target generator; and a target supply controller configured to control a temperature of the target material in the target generator to be higher than the temperature of the target material in the refinement tank.

* * * * *